US009981157B2

(12) United States Patent
Bayerlein et al.

(10) Patent No.: US 9,981,157 B2
(45) **Date of Patent: *May 29, 2018**

(54) TREADMILL WITH INTEGRATED WALKING REHABILITATION DEVICE

(71) Applicant: Woodway USA, Inc., Waukesha, WI (US)

(72) Inventors: Douglas G. Bayerlein, Oconomowoc, WI (US); Nicholas A. Oblamski, Waukesha, WI (US); Robert L. Zimpel, Menomonee Falls, WI (US); Dane J. Langer, Helenville, WI (US); Jose D. Bernal-Ramirez, West Allis, WI (US)

(73) Assignee: Woodway USA, Inc., Waukesha, WI (US)

( * ) Notice: Subject to any disclaimer, the term of this patent is extended or adjusted under 35 U.S.C. 154(b) by 763 days.

This patent is subject to a terminal disclaimer.

(21) Appl. No.: 14/562,106

(22) Filed: Dec. 5, 2014

(65) Prior Publication Data

US 2015/0087484 A1 Mar. 26, 2015

Related U.S. Application Data

(63) Continuation of application No. 13/797,533, filed on Mar. 12, 2013, now Pat. No. 8,920,347.

(Continued)

(51) Int. Cl.

*A61H 1/00* (2006.01)
*A63B 22/02* (2006.01)

(Continued)

(52) U.S. Cl.

CPC ..... *A63B 22/0235* (2013.01); *A61H 1/0262* (2013.01); *A63B 21/00178* (2013.01);

(Continued)

(58) Field of Classification Search

CPC .. A61H 3/00; A61H 1/00; A63B 22/02; A63B 22/0235; A63B 22/0242; A63B 22/0257; A63B 22/0285; A63B 22/0228

See application file for complete search history.

(56) References Cited

U.S. PATENT DOCUMENTS 219,439 A 9/1879 Blend
1,211,765 A 1/1917 Schmidt (Continued)

FOREIGN PATENT DOCUMENTS

AU 2007302381 B2 4/2008
CN 1669540 A 9/2005

(Continued)

OTHER PUBLICATIONS

Astilean, Alex, YouTube Video entitled "SpeedFit—Speedboard—First Curve Prototype" asserted to be uploaded on Jan. 14, 2009, retrieved from the internet at: https://www.youtube.com/watch?v=dO9h-F-JVCU on Apr. 6, 2015, 49 pages of screenshots.

(Continued)

*Primary Examiner* — Justine Yu
*Assistant Examiner* — Timothy Stanis
(74) *Attorney, Agent, or Firm* — Foley & Lardner LLP

(57) ABSTRACT

A treadmill for providing walking rehabilitation to a rehabilitee is provided. The treadmill includes a base including a belt, a motor interconnected with the belt, and a walking rehabilitation device interconnected with the base. The motor causes the belt to rotate in a first direction. The walking rehabilitation device includes a user engagement structure configured to be removably secured to one or more locations of a rehabilitee's extremities. The walking rehabilitation device further includes a transmission interconnecting the motor and the user engagement structure, the transmission transferring motion from the motor to the (Continued)

rehabilitee via the user engagement structure, allowing the rehabilitee to walk along the belt.

16 Claims, 34 Drawing Sheets

Related U.S. Application Data

(60) Provisional application No. 61/706,018, filed on Sep. 26, 2012, provisional application No. 61/754,785, filed on Jan. 21, 2013.

(51) Int. Cl.
*A63B 69/00* (2006.01)
*A61H 1/02* (2006.01)
*A63B 21/00* (2006.01)
*A61H 3/00* (2006.01)

(52) U.S. Cl.
CPC .... *A63B 21/00181* (2013.01); *A63B 69/0064* (2013.01); *A61H 3/008* (2013.01); *A61H 2201/0176* (2013.01); *A61H 2201/1215* (2013.01); *A61H 2201/164* (2013.01); *A61H 2201/1616* (2013.01); *A61H 2201/5046* (2013.01)

(56) References Cited

U.S. PATENT DOCUMENTS

| | | | | |
|---|---|---|---|---|
| 3,824,994 | A | 7/1974 | Soderberg, Sr. | |
| 4,204,673 | A | 5/1980 | Speer, Sr. | |
| 4,614,337 | A | 9/1986 | Schonenberger | |
| 5,470,293 | A | 11/1995 | Schonenberger | |
| 5,577,598 | A | 11/1996 | Schoenenberger | |
| 6,146,315 | A | 11/2000 | Schonenberger | |
| 6,348,025 | B1 | 2/2002 | Schonenberger | |
| 6,666,831 | B1 | 12/2003 | Edgerton et al. | |
| 6,689,075 | B2 | 2/2004 | West | |
| 6,796,926 | B2 | 9/2004 | Reinkensmeyer et al. | |
| 6,821,233 | B1 | 11/2004 | Colombo et al. | |
| 7,037,241 | B2 | 5/2006 | Kuo | |
| 7,041,069 | B2 | 5/2006 | West | |
| 7,331,906 | B2 | 2/2008 | He et al. | |
| 7,883,450 | B2 | 2/2011 | Hidler | |
| 8,690,738 | B1 | 4/2014 | Astilean | |
| 9,005,085 | B2 | 4/2015 | Astilean | |
| 2004/0087418 | A1 | 5/2004 | Eldridge | |
| 2004/0097330 | A1 | 5/2004 | Edgerton et al. | |
| 2006/0229167 | A1 | 10/2006 | Kram et al. | |
| 2008/0234113 | A1* | 9/2008 | Einav | A61B 5/103 482/66 |
| 2008/0249438 | A1 | 10/2008 | Agrawal et al. | |
| 2008/0255488 | A1 | 10/2008 | Agrawal et al. | |
| 2009/0215589 | A1* | 8/2009 | Schoenenberger | A61H 1/0214 482/54 |
| 2009/0306548 | A1 | 12/2009 | Bhugra et al. | |
| 2010/0152629 | A1 | 6/2010 | Haas et al. | |
| 2010/0285929 | A1* | 11/2010 | Bayerlein | A61H 1/0237 482/54 |
| 2010/0298102 | A1 | 11/2010 | Bosecker et al. | |
| 2011/0275043 | A1 | 11/2011 | Liu | |
| 2014/0011642 | A1 | 1/2014 | Astilean | |

FOREIGN PATENT DOCUMENTS

| | | |
|---|---|---|
| CN | 101862255 | 10/2010 |
| DE | 25 03 118 | 4/1976 |
| DE | 298 18 870 | 1/2000 |
| DE | 101 39 276 | 5/2002 |
| DE | 10 2005 017 330 | 10/2006 |
| DE | 20 2006 011 767 | 11/2006 |
| EP | 0 218 8 A1 | 6/1979 |
| EP | 0 364 992 A2 | 10/1989 |
| JP | 2001-286577 | 10/2001 |
| WO | WO-98/10839 | 3/1998 |
| WO | WO-2004/050191 | 6/2004 |
| WO | WO-2008/124025 | 10/2008 |

OTHER PUBLICATIONS

Photographs of public display of Speedfit Speedboard by Woodway presented at IHRSA Tradeshow on Mar. 17, 2009, 8 pages.
International Preliminary Report on Patentability for PCT Application No. PCT/US2013/061737, dated Apr. 9, 2015, 10 pages.
Office Action from corresponding Chinese Application No. 201380048753.3, dated May 23, 2016, 6 pages.
Extended European Search Report for EP Application No. 13842005.4, dated Apr. 22, 2016, 8 pages.
International Search Report and Written Opinion for Application No. PCT/US2013/061737, dated Jan. 6, 2014, 11 pages.
Rehabilitation Robotics. Copyright 2009 by Fraunhofer IPK. Accessed Mar. 26, 2010. http://www.ipk.fraunhofer.de/rehabrobotics. 1 page.
Rehabilitationstechnologien mit Hand und Fuβ. Copyright 2009 by Reha-Stin. Accessed Mar. 26, 2010. http://www.reha-stim.de/cms/index.php?id=48. 1 page.
Schmidt, Henning, R. Riener. Rehabilitation Robotics. Copyright 2009 by Fraunhofer IPK. Research areas. Accessed Mar. 26, 2010. http://www.ipk.fraunhofer.de/rehabrobotics/research. 5 pages.
The ALTACRO Project. Published 2006 by Virje Universiteit Brussel. Accessed Mar. 26, 2010. http://altacro.vub.ac.be/info/project.htm. 1 page.

* cited by examiner

TREADMILL WITH INTEGRATED WALKING REHABILITATION DEVICE

CROSS-REFERENCE TO RELATED PATENT APPLICATIONS

This application claims the benefit of priority as a continuation of U.S. patent application Ser. No. 13/797,533, filed Mar. 12, 2013, entitled "Treadmill with Integrated Walking Rehabilitation Device," which claims priority from both U.S. Provisional Application No. 61/706,018, filed Sep. 26, 2012, entitled "Treadmill with Integrated Walking Rehabilitation Device," and from U.S. Provisional Application No. 61/754,785, filed Jan. 21, 2013, entitled "Treadmill with Integrated Walking Rehabilitation Device." All of these applications are hereby incorporated herein by reference in their entireties.

BACKGROUND

The present application relates to the use of rehabilitation therapy that mimics walking (also referred to as "walking therapy"). More specifically, the present application relates to the use of a treadmill to provide walking therapy.

A number of disorders and injuries may cause an individual to experience complications when walking or render them unable to walk. For example, an individual may experience neurological damage due to stroke, spinal cord injury, etc. Walking therapy can help these individuals improve and/or regain their walk or gait. Such improvements may be the result of improving the training of muscle groups, improving kinesthetic awareness, and other related factors.

Walking therapy has traditionally been conducted with the help of two or more therapists that manually move a rehabilitee's legs to mimic walking motions. These traditional methods have a number of shortcomings. Among other things, these methods are very labor-intensive on the part of the physical therapists and can be subject to significant variability (e.g., due to different physical therapists working on different parts of a patient's legs, the inability to precisely control the gait of the patient's legs, etc.).

Generally, it is desirable to have more consistency when providing walking therapy. In some cases, consistency allows improvements to be more readily realized. In other cases, the results achieved are more accurate (e.g., because substantially the same muscle groups are repeatedly trained in substantially the same way, without undesirable variations, such as those occurring when a physical therapist's arms are tired, etc.). More recently, mechanically and/or robotically assisted devices that provide walking rehabilitation have been found to provide improved consistency.

SUMMARY

One embodiment relates to a treadmill for providing walking rehabilitation to a rehabilitee. The treadmill includes a base including a belt, a motor interconnected with the belt, and a walking rehabilitation device interconnected with the base. The motor causes the belt to rotate in a first direction. The walking rehabilitation device includes a user engagement structure configured to be removably secured to one or more locations of a rehabilitee's extremities. The walking rehabilitation device further includes a transmission interconnecting the motor and the user engagement structure, the transmission transferring motion from the motor to the rehabilitee via the user engagement structure, allowing the rehabilitee to walk along the belt.

Another embodiment relates to an apparatus for providing walking rehabilitation to a rehabilitee on a treadmill having a walking belt powered by a motor. The apparatus includes a user engagement structure configured to be removably secured to one or more locations of a rehabilitee's extremities, and a transmission coupled to the user engagement structure and configured to take power from the motor that is not transferred through the belt, rather power is transferred through the transmission from the motor into motion of the user engagement structure, thereby allowing the rehabilitee to walk along the walking belt.

Another embodiment relates to a method providing walking rehabilitation. The method includes providing a treadmill having a motor interconnected with a walking belt and having a user engagement structure. The user engagement structure is configured to be removably secured to one or more locations of a rehabilitee's extremities and is interconnected with the motor via a kinetic pathway other than the walking belt. The method further includes causing the walking belt to rotate in a first direction via a first portion of the power from the motor, and transferring a second portion of the power from the motor to the rehabilitee via the user engagement structure, thereby replicating in the extremities of the rehabilitee a walking motion along the walking belt.

The foregoing is a summary and thus, by necessity, contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
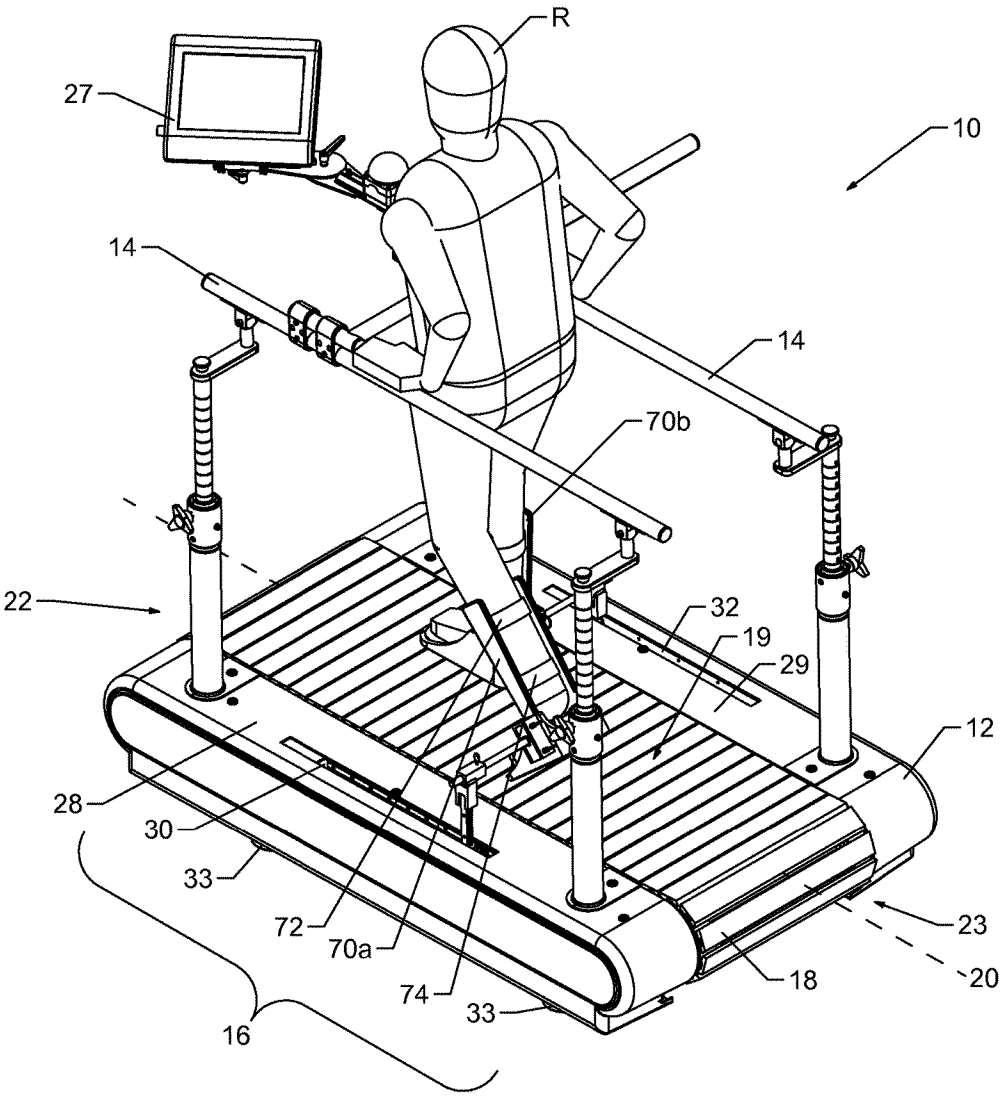
FIG. 1 is a top, left-side, rear perspective view of a treadmill having an integrated walking rehabilitation device, shown with a rehabilitee according to an exemplary embodiment.

Referring generally to the Figures, a treadmill 10 with an integrated walking rehabilitation device (e.g., walking rehabilitation device 16, walking rehabilitation device 316, etc.) is shown according to an exemplary embodiment. The treadmill 10 includes a walking belt 18 and a motor 102 operatively coupled to the walking belt 18 to cause rotation thereof. The treadmill 10 further includes a transmission (e.g., transmission 100, transmission 400, etc.) that transfers motive force from the motor 102 to a user engagement structure (e.g., user engagement structure 70, user engagement structure 370). The user engagement structure 70, 370 may be removably secured to a rehabilitee R such that motion of the user engagement structure 70, 370 causes the rehabilitee R to walk with a desired gait. Thus, a single motor 102 may cause both the rotation of the walking belt 18 and the rehabilitative walking motion of the rehabilitee R. Preferably, the transmission 100, 400 synchronizes the walking motion of the rehabilitee R with the speed of a walking surface 19 of the walking belt 18 such that operation of the treadmill 10 with the walking rehabilitation device 16, 316 simulates a desired gait. Using a single motor 102 facilitates maintenance and repair of the treadmill 10, and having a transmission 100, 400 that takes power from the motor 102, rather than the walking belt 18, reduces de-synchronization of the walking belt 18 and the user engagement structure 70, 370, thereby increasing the amount of motive force that can be transferred through the walking rehabilitation device 16, 316 to the rehabilitee.

According to the exemplary embodiment shown, the transmission 100, 400 takes off power from a rear shaft assembly 60, which also drives the walking belt 18. The transmission 100, 400 corrects the direction of rotation through a reverse shaft assembly 110, 410, which turns a drive shaft assembly 120, 420, which in turn rotates a chain 136, 436. The chain 136, 436 follows a path 140, 440 around the drive shaft assembly 120, 420 and an idler shaft assembly 130, 430. A follower assembly 150, 450, coupled to the user engagement structure 70, 370 device, follows the path 140, 440 of the chain 136, 436, thereby generating a desired gait.

Referring briefly to FIGS. 18-24 and FIGS. 25-37, other exemplary embodiments of the treadmill 10 may include a transmission 100, 400, walking rehabilitation device 16, 316, follower assembly 150, 250, 450, user engagement structure 70, 370, or any combination of these or other components describe in this disclosure. Components having similar function and/or structure are described with similar nomenclature and numbering, as will be recognized and understood by a person of skill in the art in reviewing this disclosure.

Before discussing further details of the treadmill and/or the components thereof, it should be noted that references to "front," "back," "rear," "upward," "downward," "inner," "outer," "right," and "left" in this description are merely used to identify the various elements as they are oriented in the Figures. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 2:
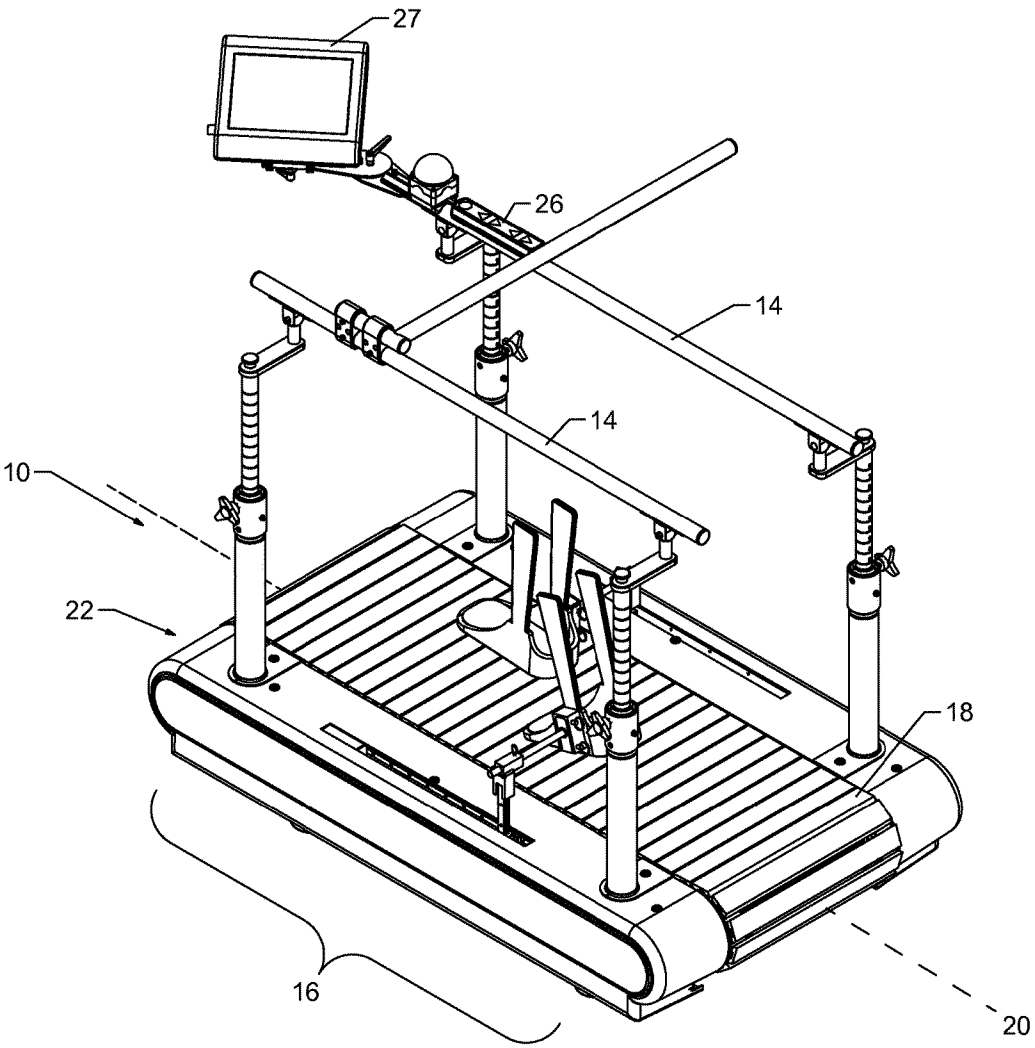
FIG. 2 is another top, left-side, rear perspective view of the treadmill of FIG. 1, shown according to an exemplary embodiment.

Referring to FIGS. 1 and 2, a treadmill 10 generally comprising a base 12, one or more handrails 14 mounted to the base 12, an integrated walking rehabilitation device 16, and components thereof, are shown according to an exemplary embodiment. The walking rehabilitation device 16 is configured to help a rehabilitee R (e.g., user, etc.) to restore or improve their gait by guiding the rehabilitee's lower extremities to move according to a desirable gait pattern. With repeated use, the walking rehabilitation device 16 may, among other things, help a rehabilitee relearn to walk in a physically correct manner, improve their muscle function, improve their muscle memory, and improve their kinesthetic awareness, as will be discussed in more detail below.

Figure 4:
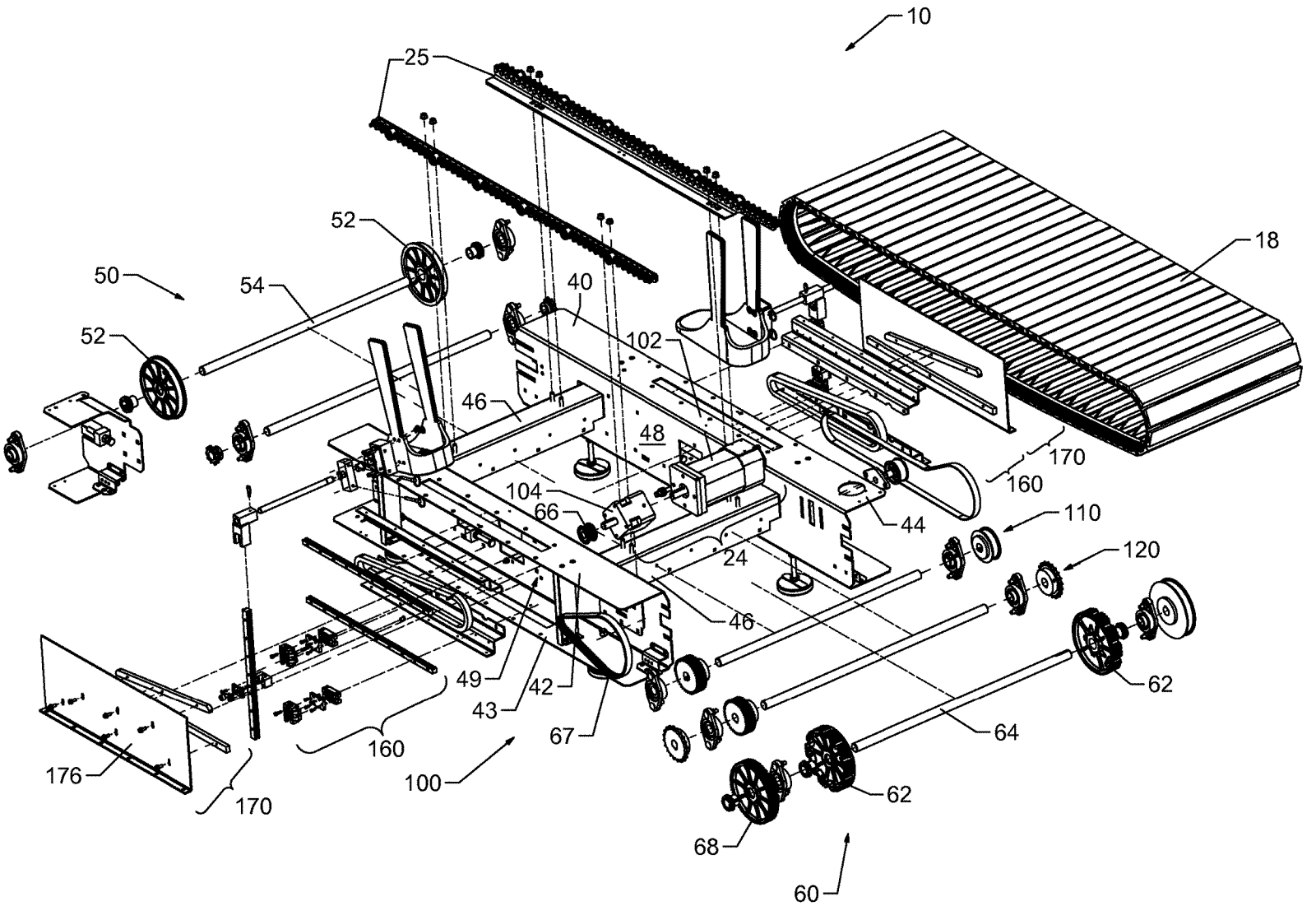
FIG. 4 is a top, left-side, rear exploded view of a portion of the treadmill of FIG. 2, shown according to an exemplary embodiment.

The base 12 includes a walking belt 18 (e.g., running belt, slats, etc.) that extends substantially longitudinally along a longitudinal axis 20. The longitudinal axis 20 extends generally between a forward or front end 22 and an aft or rear end 23 of the treadmill 10; more specifically, the longitudinal axis 20 extends generally between the centerlines of a front and rear shaft, which will be discussed in more detail below. The walking belt 18 includes an upper portion (e.g., running surface, upper region, etc.), shown as walking surface 19, that contacts and supports the rehabilitee R. The walking belt 18 is driven longitudinally by a motor assembly 24 and is guided by a pair of bearing rails 25 (see FIG. 4 illustrating the motor assembly 24 and the bearing rails 25). The motor assembly 24 is shown to include a drive motor 102, shown to be an electric motor, and a gearbox 104, which provides gear reduction (e.g., between 3:1 and 8:1, 5:1, etc.) of the output of the drive motor 102. According to another embodiment, the treadmill 10 may not include a gearbox 104. The speed at which the walking belt 18 is driven by the motor assembly 24 may be adjusted by conventional means (e.g., using buttons on a control panel 26, using a touch sensitive display 27 [e.g., touchscreen, etc.], using a computer, etc.).

A pair of side panels 28, 29 (e.g., covers, shrouds, etc.) are provided on the right and left sides of the base 12 to effectively shield the rehabilitee from the components or moving parts of the treadmill 10. Openings 30, 32 in the side panels 28, 29 allow for a structure of the walking rehabilitation device 16 to extend above the walking belt 18 to be operatively coupled to the rehabilitee in the exemplary embodiment shown. It should be noted that brushes or other similar elements may be disposed in the openings 30, 32 to help prevent undesired objects from entering the openings.

Figure 15:
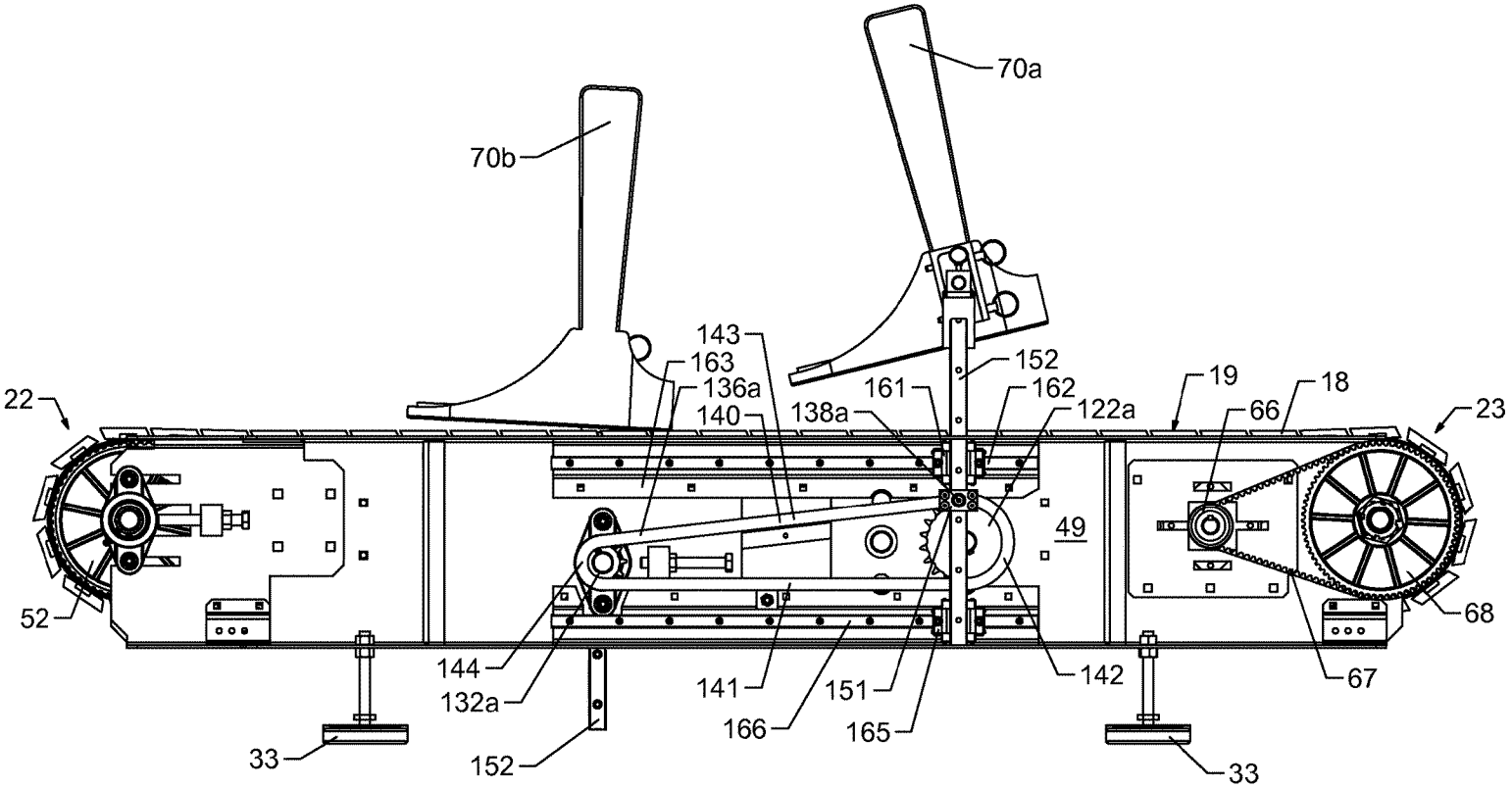
FIG. 15 is a left-side elevation view of a portion of the components of the treadmill of FIG. 14, shown according to an exemplary embodiment.
Figure 16:
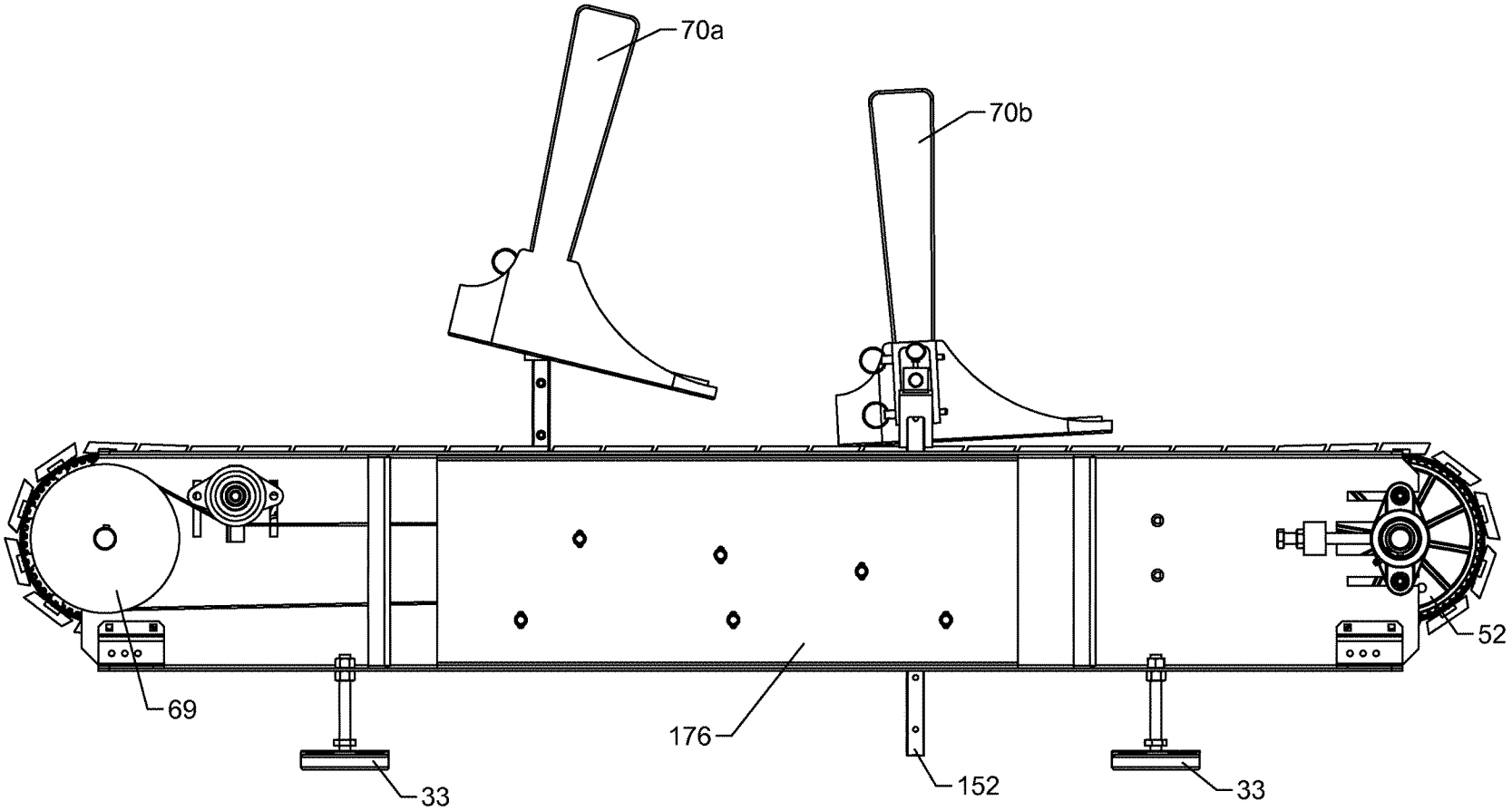
FIG. 16 is a right-side elevation view of a portion of the components of the treadmill of FIG. 2, shown according to an exemplary embodiment.

The treadmill 10 is shown further including one or more support members disposed generally beneath the base 12 according to an exemplary embodiment. The support members provide clearance for the moving components, in particular, the vertically movable components, of the walking rehabilitation device 16 (see, e.g., FIGS. 15 and 17). In the exemplary embodiment shown, the support members include four support legs 33 that raise the base 12 a distance off the ground. The moving components of the walking rehabilitation device 16, which are movably coupled to the base 12, are correspondingly raised a distance off the ground. It should be noted that the support members may have any configuration suitable to accommodate the moving parts of the walking rehabilitation device. According to some exemplary embodiments, a pit installation may be used. In one exemplary embodiment, a pit installation involves forming a pit (e.g., opening, cavity, hole, etc.) in the ground under the space in which the treadmill 10 will be located. The treadmill 10 is disposed generally above the pit and the moving components of the walking rehabilitation system are accommodated within the pit. In some of these configurations, this allows the base 12 and/or walking surface 19 of the treadmill 10 to be positioned substantially flush with the ground, thereby allowing a physical therapist or other person to more readily assist the rehabilitee. In another exemplary embodiment, a raised platform may be built-up around the treadmill 10. Referring briefly to FIGS. 34-37, other embodiments of the transmission (e.g., transmission 400) may allow the walking surface 19 to be positioned lower to the ground.

Figure 3:
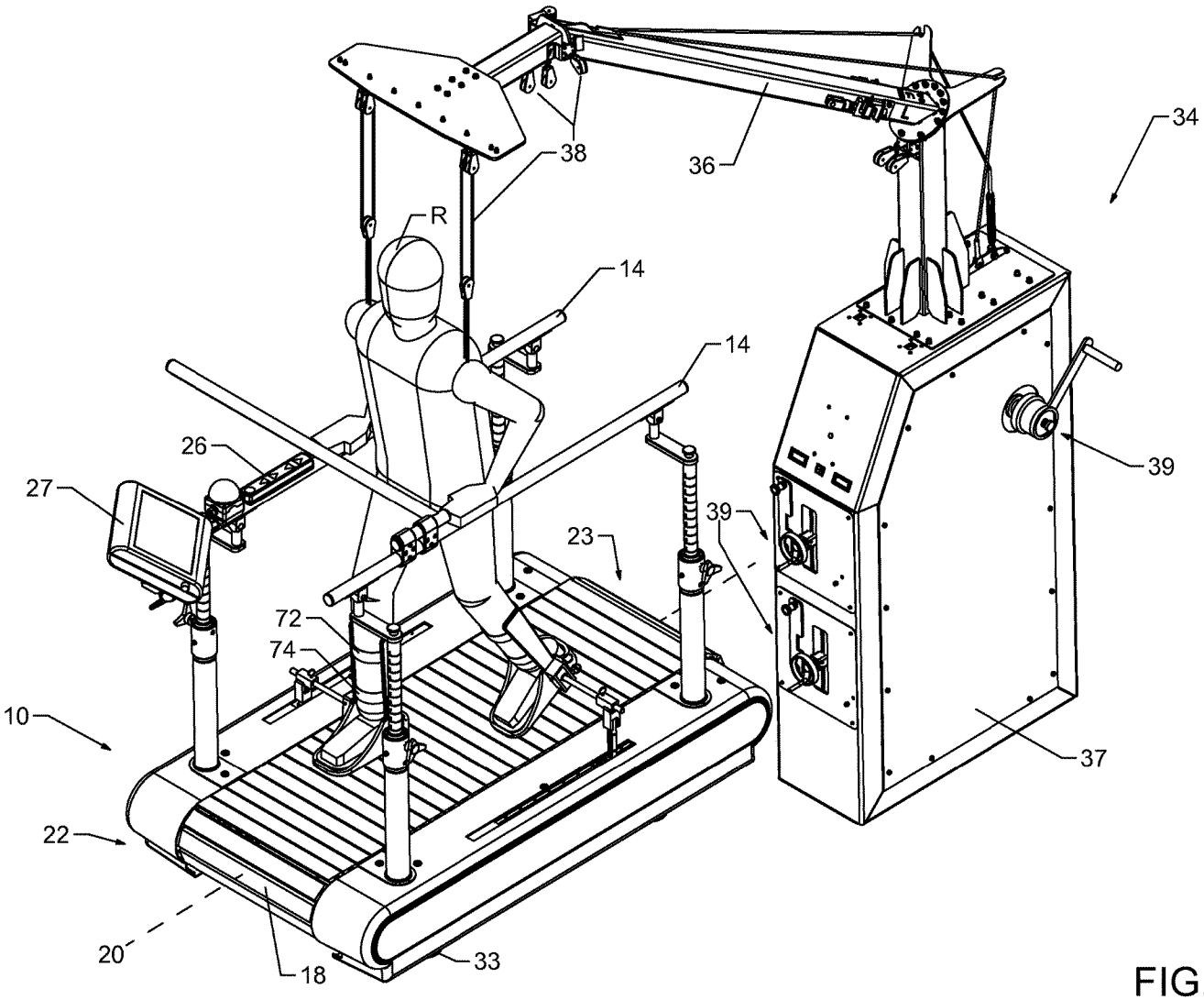
FIG. 3 is a top, left-side, front perspective view of a treadmill having an integrated walking rehabilitation device, shown with a rehabilitee according to another exemplary embodiment.

The handrails 14 are shown extending along the right-hand and left-hand sides of the treadmill 10, laterally spaced apart and generally parallel to the longitudinal axis 20. It should be noted that the left and right-hand sides of the treadmill and various components thereof are defined from the perspective of a forward-facing user standing on the walking surface 19 of the treadmill 10. A rehabilitee may utilize the handrails 14 for support (e.g., keeping themselves upright, partially supporting the weight of their body, etc.). Further, the handrails 14 may be configured to be adjustable, to accommodate users of different heights, builds, etc. According to the exemplary embodiments shown in FIG. 3, a body weight support system 34 configured to support or allow one to support at least part of the weight of the rehabilitee may be utilized with the treadmill 10 (e.g., a mechanical counterweight, a pneumatic device, a servo-controlled device, etc.) alone or in combination with the handrails 14 and/or handrails having other suitable configurations. As shown, the body weight support system 34 includes a boom 36 extending from a base 37. A pulley or block and tackle system 38 is used to support some or all of the weight of the rehabilitee R. One or more manual or motorized winches 39 may be used to control the position of the boom 36 and the force applied to the rehabilitee. These devices may be removable or integrated with the treadmill 10. U.S. Pat. No. 7,883,450 to Hidler, incorporated herein by reference in its entirety, discloses another body weight support system that may be used with the treadmill 10.

Referring to FIG. 4, the base 12 is shown to include a frame 40 that comprises longitudinally-extending, opposing side members, shown as a left-side member 42 and a right-side member 44, and one or more lateral or cross-members 46 extending between and structurally connecting the side members 42, 44, according to an exemplary embodiment. Each side member 42, 44 includes an inner surface 48 and an outer surface 49. The inner surface 48 of the left-side member 42 is opposite to and faces the inner surface 48 of the right-side member 44. According to other exemplary embodiments, the frame may have substantially any configuration suitable for providing structure and support for the treadmill.

A front shaft assembly 50 and a rear shaft assembly 60 are coupled to the frame 40 according to an exemplary embodiment. The front shaft assembly 50 includes at least one, preferably a pair of front belt pulleys 52 interconnected with a front shaft 54. For example, the pulleys 52 are preferably mounted on the front shaft 54 using a bushing (e.g., a tapered bore keyless bushing) to secure the pulleys 52 to the front shaft 54. The rear shaft assembly 60 includes at least one, preferably a pair of rear belt pulleys 62 and a secondary or rear motor pulley 68 interconnected with, and preferably mounted on, a rear shaft 64. The front and rear belt pulleys 52, 62 are configured to support and facilitate movement of the walking belt 18. The walking belt 18 is disposed about the front and rear belt pulleys 52, 62, which are preferably fixed to the front and rear shafts 54, 64, respectively. The motor assembly 24 rotates a primary or drive motor pulley 66, which drives the rear motor pulley 68 via a first or motor belt 67, chain, etc. As the rear motor pulley 68 rotates the rear shaft 64, the rear belt pulleys 62 rotate, causing the walking belt 18 and the front belt pulleys 52 to rotate in the same direction. As shown, the motor pulleys 66, 68 are toothed to engage the motor belt 67 and prevent slippage of the motor belt 67 relative to the motor pulleys. Similarly, the rear belt pulleys 62 are shown to be toothed to engage a toothed portion of the walking belt 18 and prevent slippage therebetween. According to other exemplary embodiments, the motor may be operatively coupled to the front shaft and the drive belt.

Referring generally to FIGS. 1-4, the walking rehabilitation device 16 includes a first or left-side user engagement structure 70*a* and a second or right-side user engagement structure 70*b*. The first and second user engagements structures 70*a*, 70*b* (e.g., binding, boot, etc.) may be referred to generally or collectively as the user engagement structure 70. According to an exemplary embodiment, the user engagement structures 70 are coupled to, and more preferably operably interconnected with, the rear shaft assembly 60 and the motor assembly 24 via a power transmission system (e.g., power takeoff system, driveline, kinetic pathway, etc.), shown as transmission 100, described in detail below. The user engagement structure 70 is configured to be removably secured relative to desirable locations of the rehabilitee's lower extremities in order to transfer motion from the transmission 100 to the rehabilitee, causing him or her to walk with a desirable gait. The user engagement structure 70 is coupled to, and preferably interconnected with, the transmission 100. Briefly referring to FIGS. 1-3, each of the left-side user engagement structure 70*a* and right-side user engagement structure 70*b* of the walking rehabilitation device 16 may include one or more support or coupling features, shown as straps 72, 74, to releasably and adjustably secure the user engagement structure 70 relative to the left leg or foot and the right leg or foot of the rehabilitee, respectively. In this way, driving force from the transmission 100 can be transferred from the walking rehabilitation device 16 to the rehabilitee. According to other embodiments, additional coupling features may be used to bind the rehabilitee's foot proximate the toe or arch to the user engagement structure 70.

Figure 25:
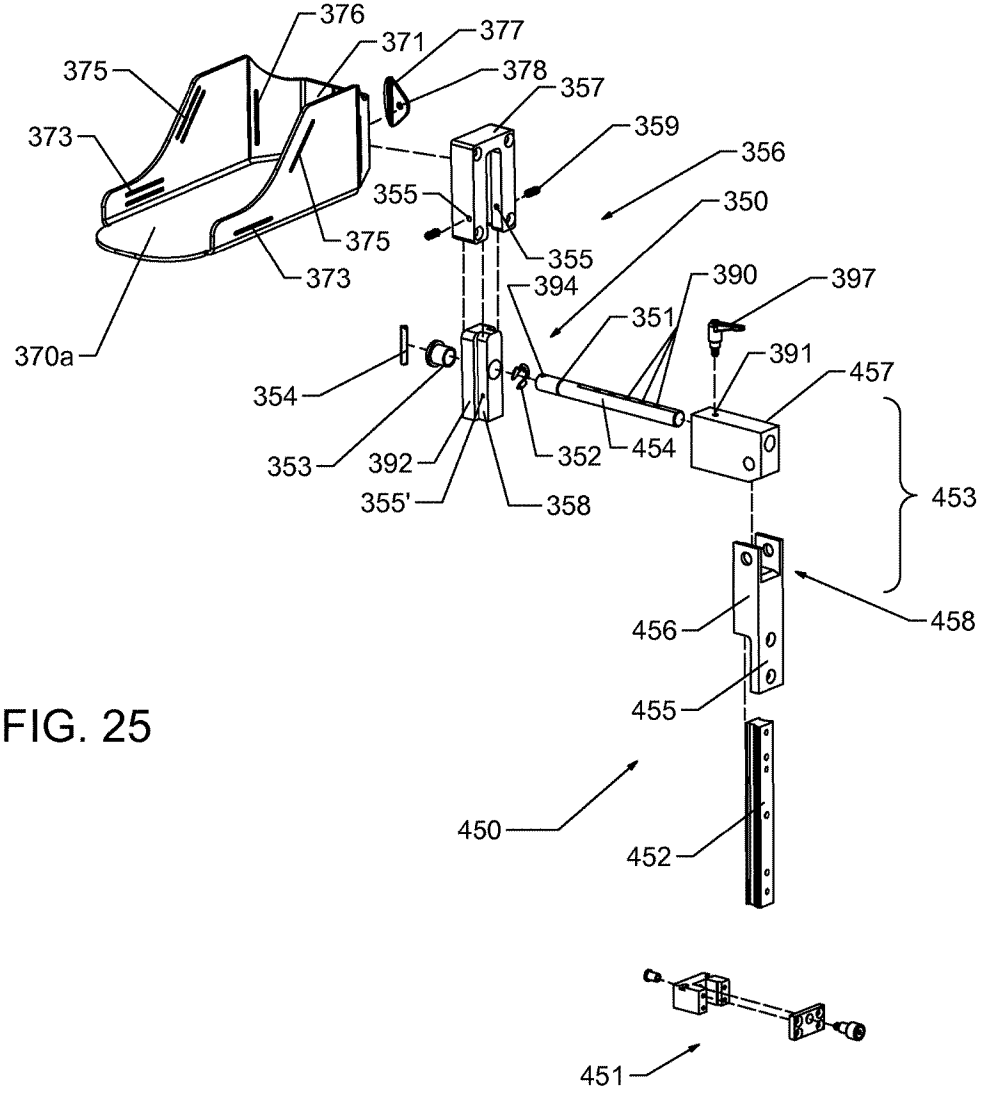
FIG. 25 is an exploded perspective view of a follower assembly and user engagement structure of the treadmill of FIG. 2, shown according to another exemplary embodiment.
Figure 28:
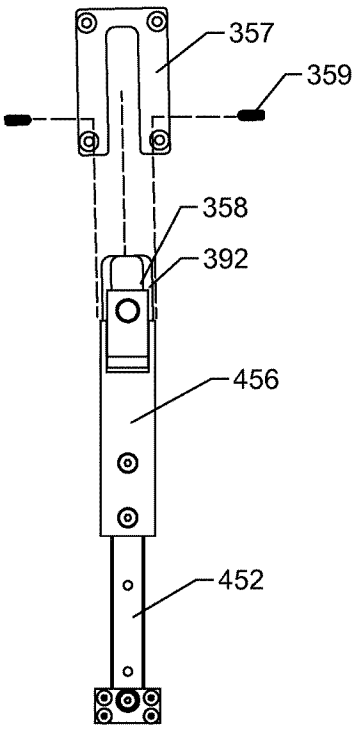
FIGS. 26-29 are orthogonal views of the follower assembly of FIG. 25, shown according to another exemplary embodiment.
Figure 27:
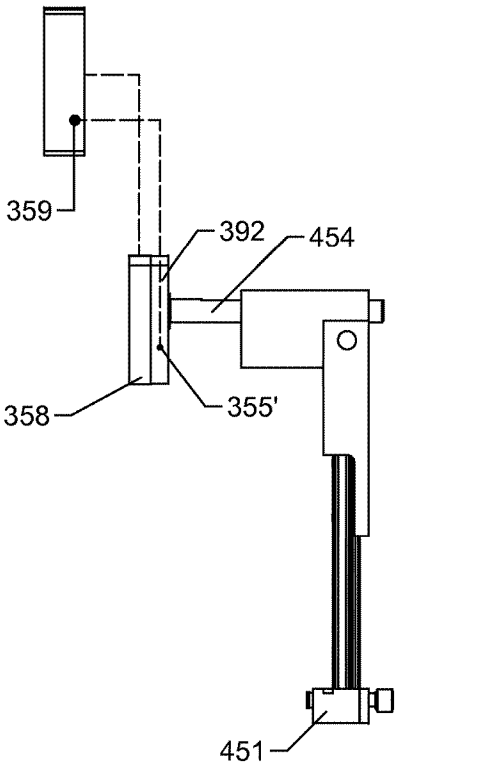
Figure 26:
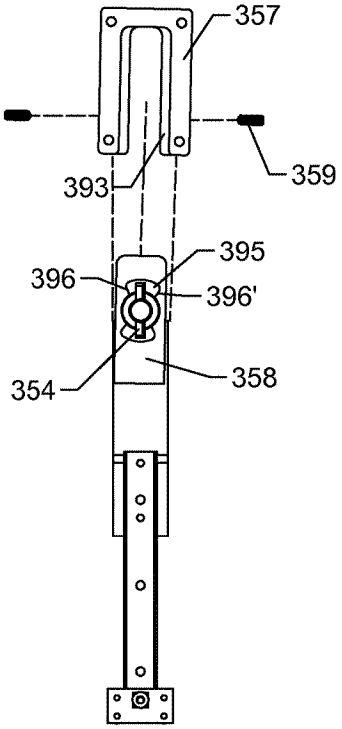
Figure 33:
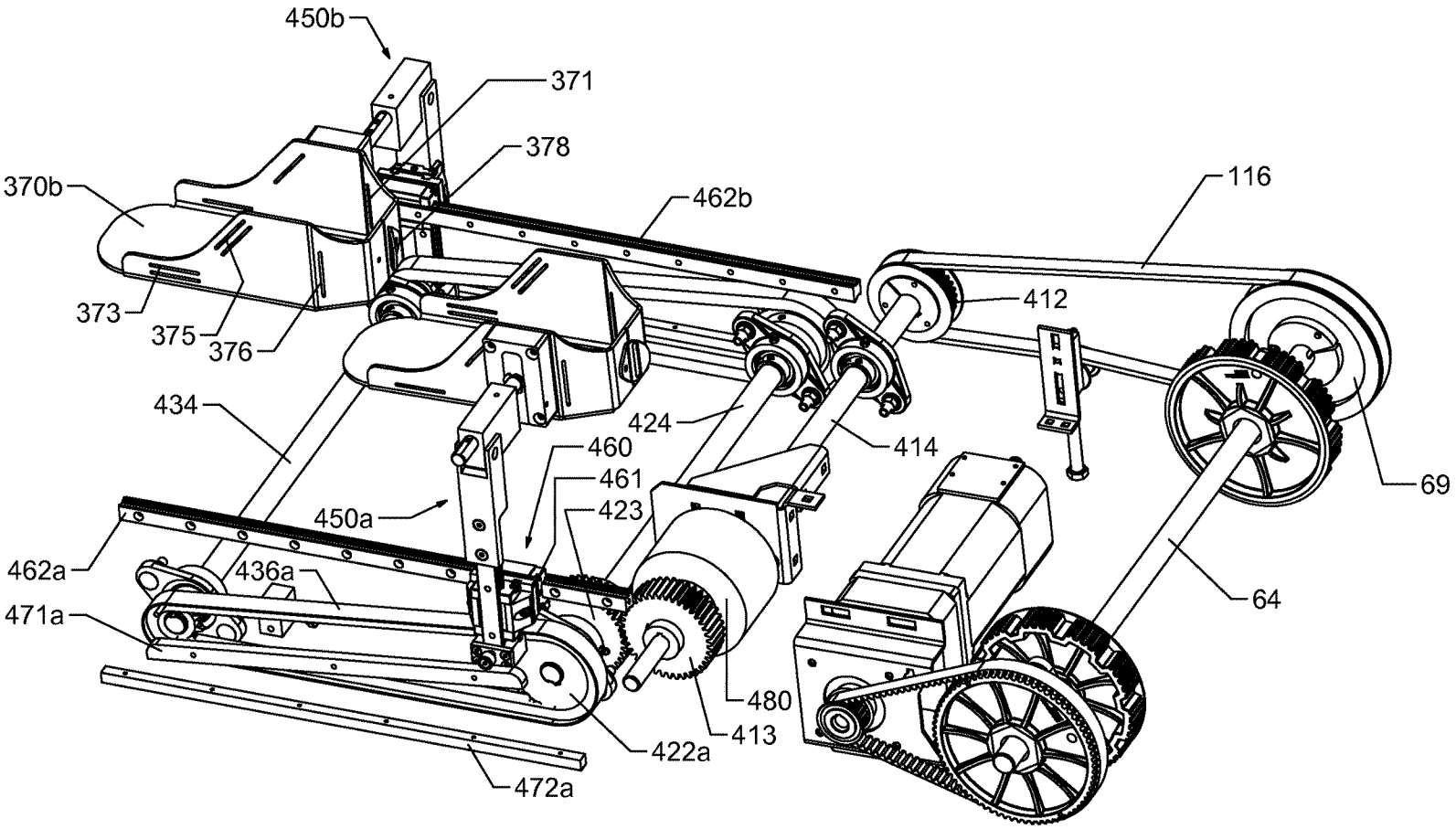
FIG. 33 is a top, left-side, rear perspective view of a portion of the components of the treadmill of FIG. 30, shown according to an exemplary embodiment.

Referring to FIGS. 25 and 33, another user engagement structure 370, shown as left-side user engagement structure 370*a* and right-side user engagement structure 370*b*, are shown according to an exemplary embodiment. The user engagement structure 370 does not engage the user about the shin or calf, instead binding securely to the rehabilitee's foot or shoe using straps (not shown). Binding to the rehabilitee's foot, rather than about the shin and calf, allows ankle rotation and foot flexure, thereby training the rehabilitee in a more natural gait. Preferably, the rehabilitee's ankle is axially aligned with lateral member 454 such that flexure of the foot corresponds to rotation of the mount 356 and lateral member 454. As not all rehabilitees have the same size foot, to align the rehabilitee's ankle with the lateral member 454, either different sizes of user engagement structure 370 must be used, or the user engagement structure 370 must include an adjustment system to accommodate different sizes of rehabilitee's feet. According to the exemplary embodiment shown, the user engagement structure 370 includes an adjustable heel portion 371. The adjustable heel portion 371 is shown to include lateral and medial slots 376 and a tightening portion 378 coupled to the rear of the user engagement portion 370. The tightening portion 378 includes a slot 377 and may be used to secure a first end of a strap (not shown). For example, a first end of the strap, preferably having a hook and loop fastening system disposed on its surfaces, is fed through the slot 377 until a second end of the strap is prevented from passing through the slot 377. The first end of the strap is then fed through lateral and medial slots 376 of the heel portion 371, and the first end of the strap is then coupled to the strap proximate the second end of the strap. In use, the location of the rehabilitee's foot relative to the user engagement structure 370 may be adjusted by selectively adjusting the relative tightness (e.g., taughtness, etc.) of the strap passing through the heel portion 371 and the straps (not shown) passing over the top of the rehabilitee's foot and through slots 373, 375. Accordingly, the user engagement structure 370 may be a one-size-fits-all boot.

Referring to FIGS. 4-17, the walking rehabilitation device 16, and components thereof, are shown according to an exemplary embodiment. While certain components of the walking rehabilitation device 16 are shown on the left side or right side of the treadmill 10, according to various other embodiments, some or all of the components may be switched to an opposite side (e.g., left to right or right to left, etc.), all of the components may be moved to one side (e.g., left-side or right-side) of the treadmill 10, or the components may be driven by the front shaft assembly 50.

Figure 5:
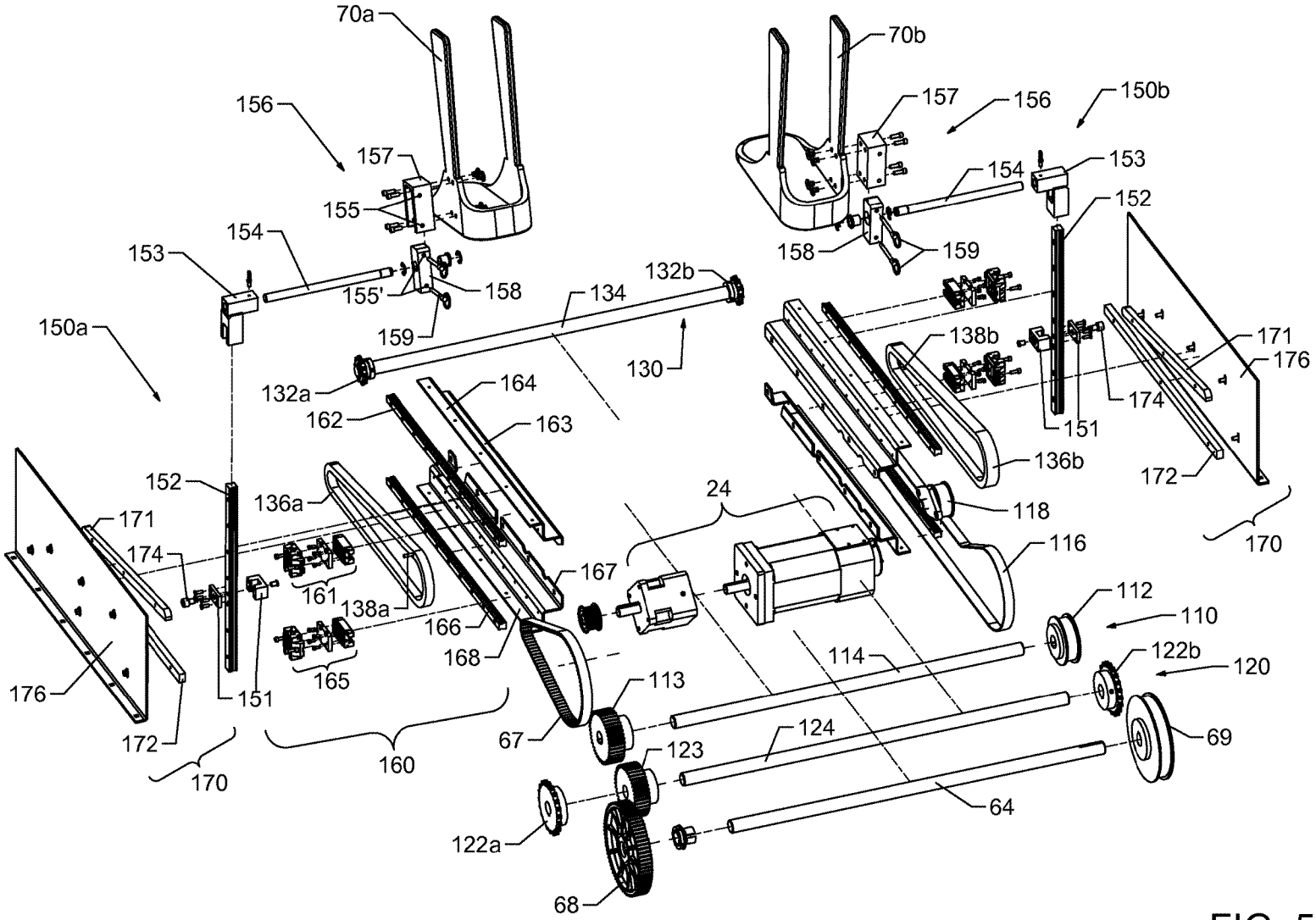
FIG. 5 is a top, left-side, rear exploded view of a portion of the components of the treadmill of FIG. 2, shown according to an exemplary embodiment.
Figure 6:
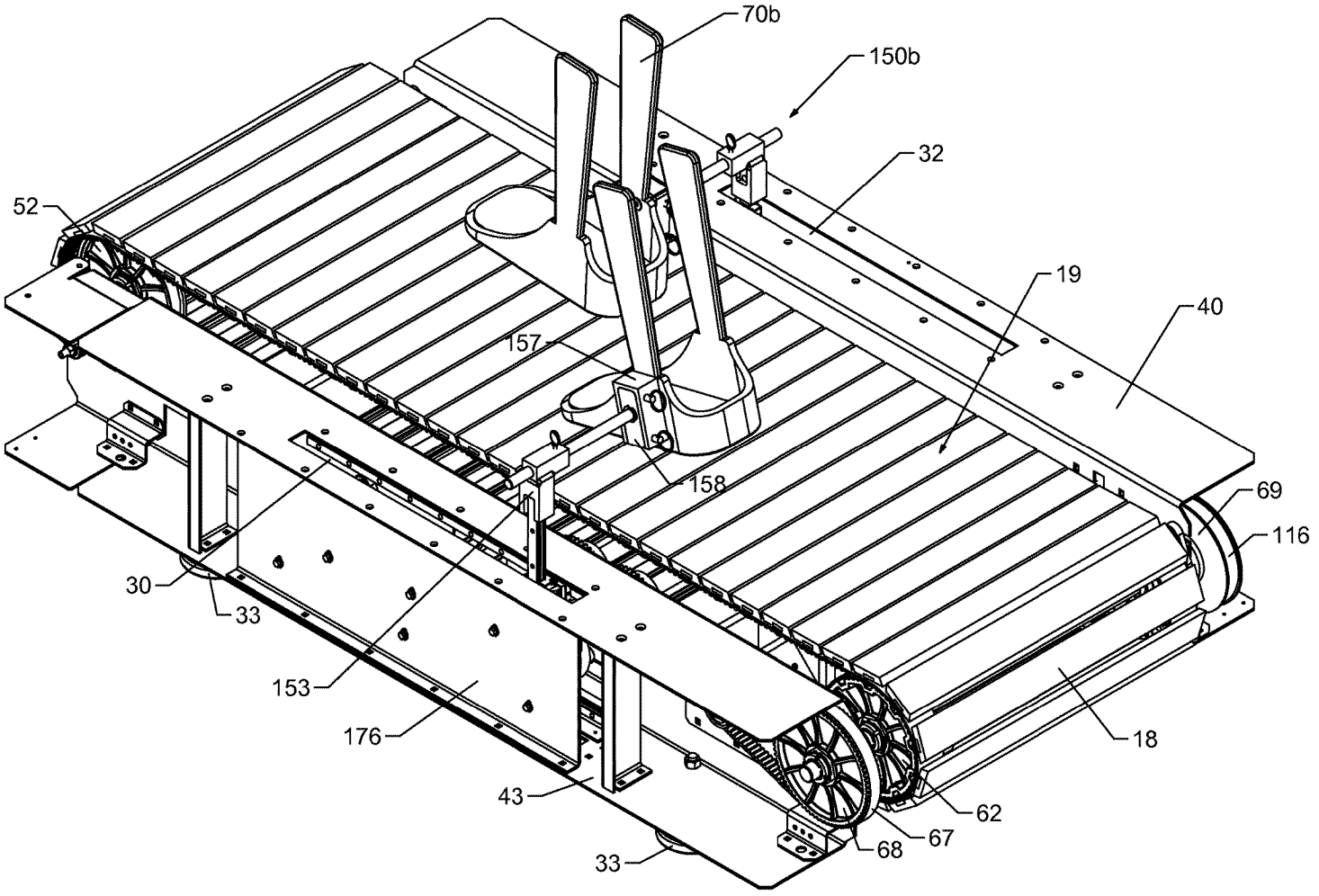
FIG. 6 is a top, left-side, rear perspective view of a portion of the components of the treadmill of FIG. 2, shown according to an exemplary embodiment.
Figure 7:
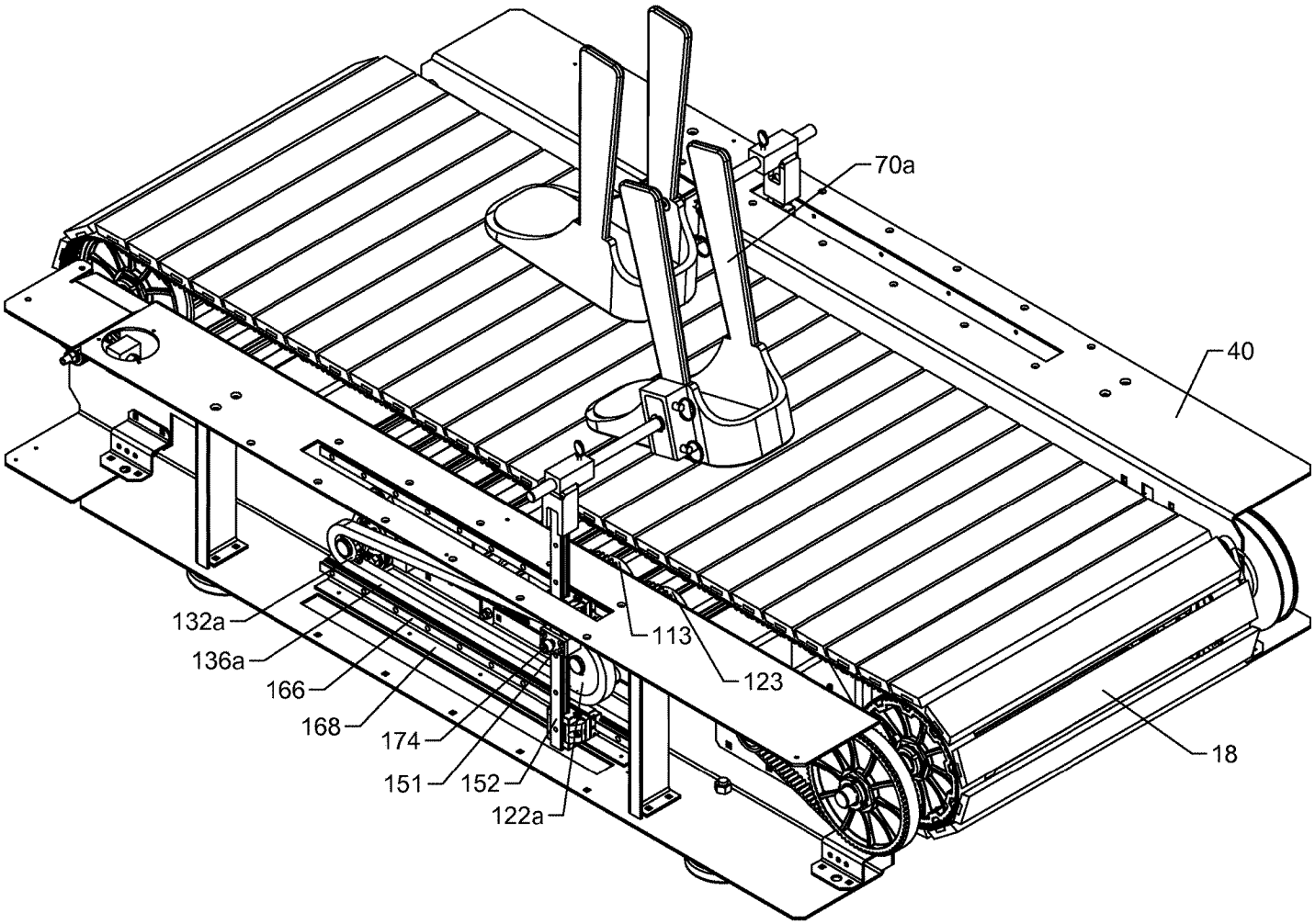
FIG. 7 is a top, left-side, rear perspective view of a portion of the components of the treadmill of FIG. 6, shown according to an exemplary embodiment.
Figure 8:
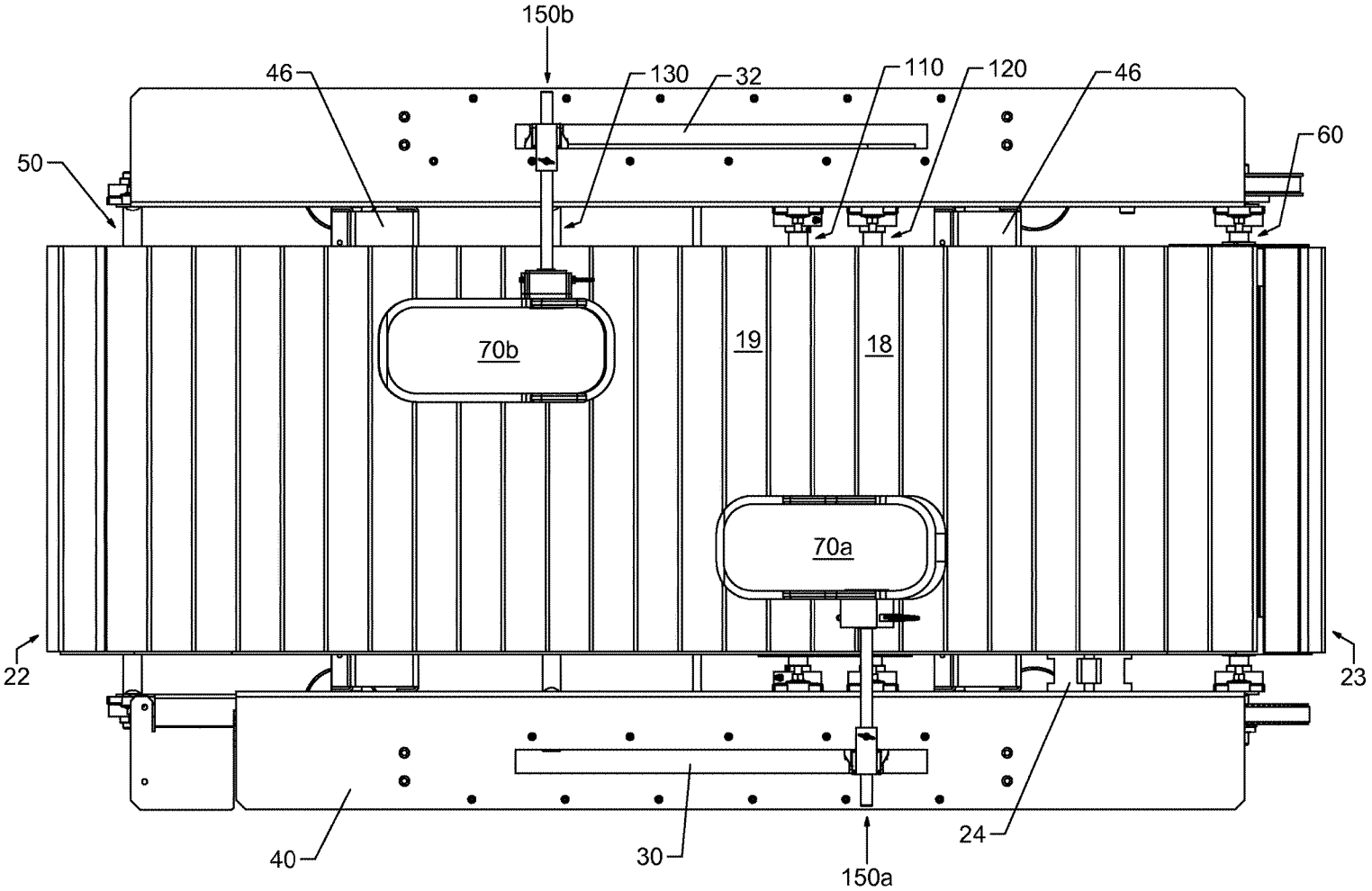
FIG. 8 is a top plan view of a portion of the components of the treadmill of FIG. 2, shown according to an exemplary embodiment.
Figure 9:
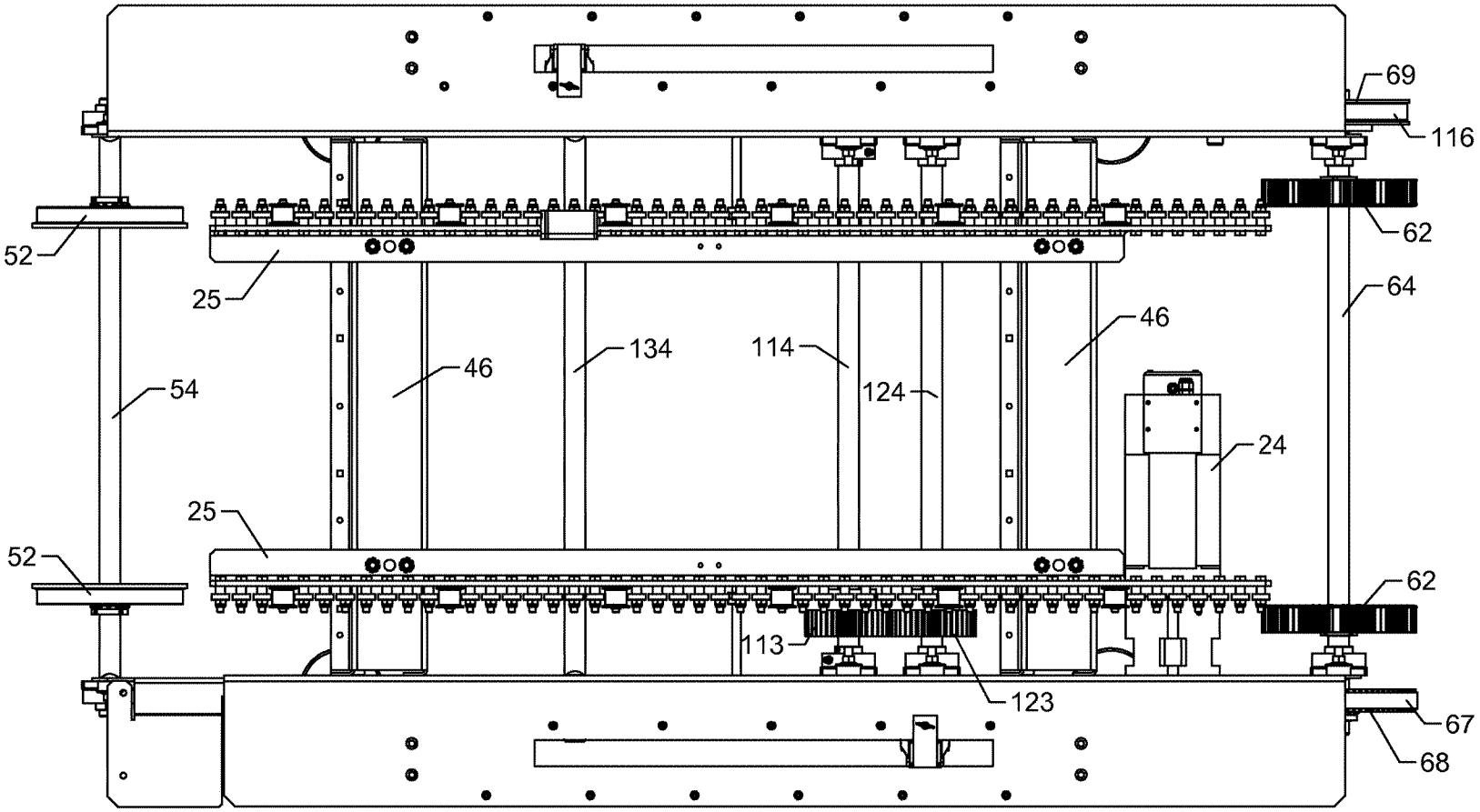
FIG. 9 is a top plan view of a portion of the components of the treadmill of FIG. 8, shown according to an exemplary embodiment.
Figure 13:
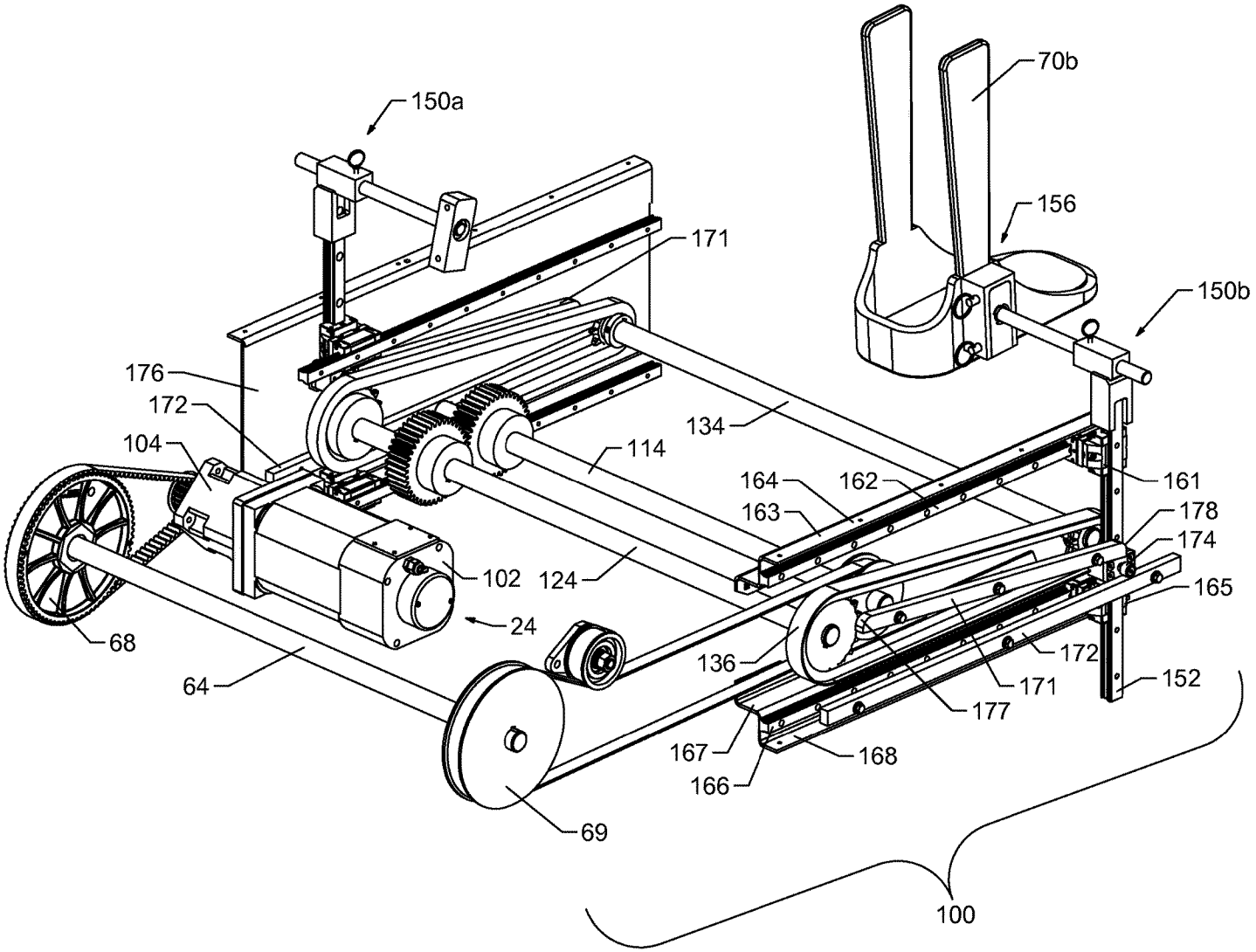
FIG. 13 is a top, right-side, rear perspective view of a portion of the components of the treadmill of FIG. 12, shown according to an exemplary embodiment.
Figure 14:
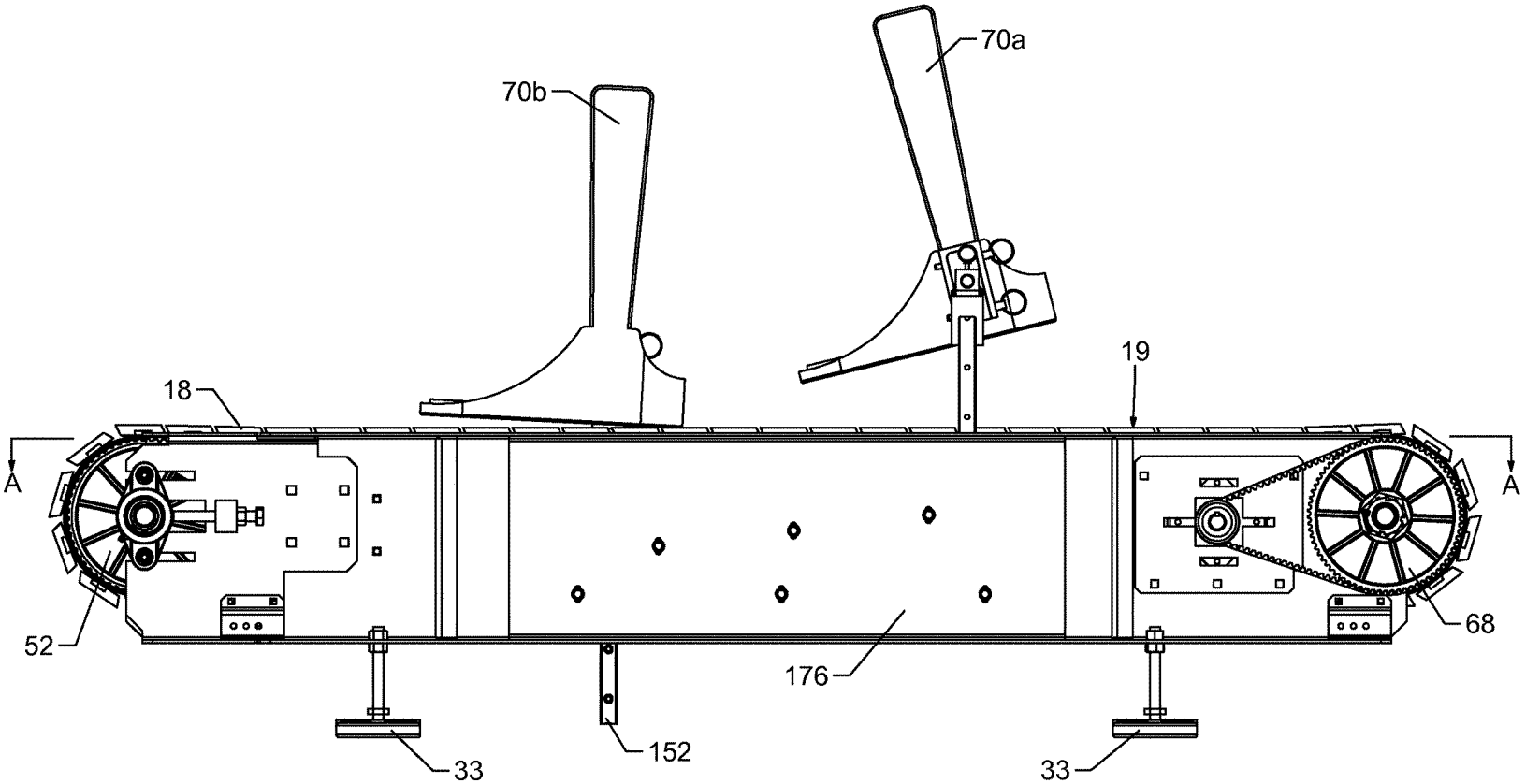
FIG. 14 is a left-side elevation view of a portion of the components of the treadmill of FIG. 1B, shown according to an exemplary embodiment.

According to the exemplary embodiment shown, and as best seen in FIGS. 5 and 13, the walking rehabilitation device 16 includes a transmission 100 and a follower assembly 150, wherein the follower assembly 150 couples to the user engagement device 70, and the transmission 100 receives power or motive force from the motor assembly 24 and transfers and/or transforms the motive force to cause motion of the follower assembly 150, thereby causing motion of the user engagement device 70, and in turn causing motion of the rehabilitee. The transmission 100 is shown to include a power takeoff pulley 69 interconnected with, and preferably mounted on the rear shaft 64. The transmission 100 further includes a reverse shaft assembly 110 configured to receive motive force from the power takeoff pulley 69 and to reverse or correct the direction of rotation of the motive force, a drive shaft assembly 120 configured to receive the motive force from the reverse shaft assembly 110 and to drive a chain 136, and an idler shaft assembly 130 configured to support and at least partially define a path 140 of the chain 136. The follower assembly 150 movably couples to, and follows the path of, the chain 136.

Figure 17:
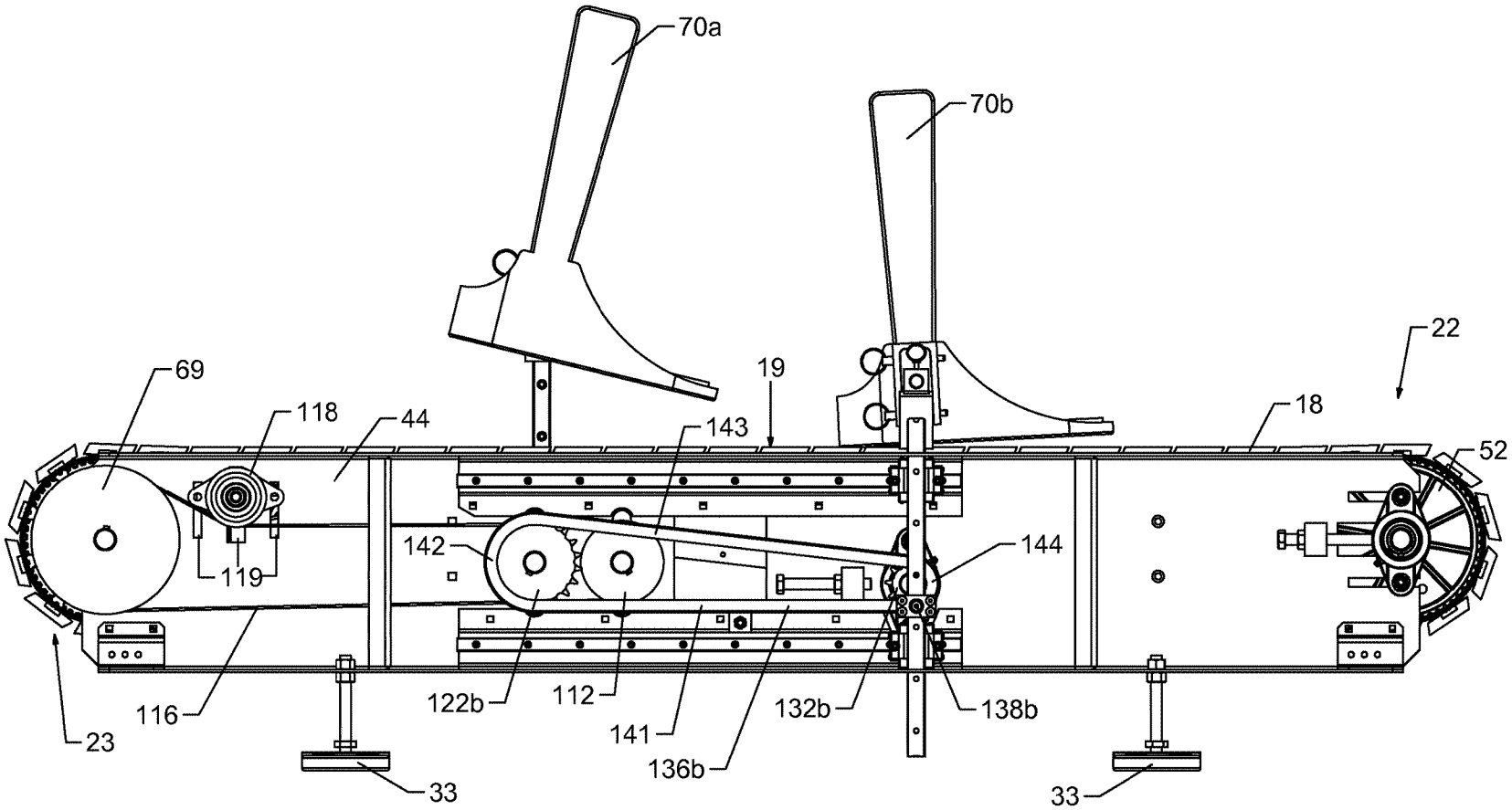
FIG. 17 is a right-side elevation view of a portion of the components of the treadmill of FIG. 16, shown according to an exemplary embodiment.

The reverse shaft assembly includes a pulley 112 and a gear 113 interconnected with, and preferably mounted on, a shaft, shown as a reverse shaft 114. The pulley 112 is interconnected with the power takeoff pulley 69 via a second or takeoff belt 116. According to one embodiment, the power takeoff pulley 69 and the pulley 112 may be toothed to engage a toothed inner portion of the takeoff belt 116, thereby preventing slippage therebetween. A tensioner 118 may apply force to the takeoff belt 116 to guide the takeoff belt 116 and to take up any slack in the takeoff belt 116. As shown in FIG. 17, the tensioner 118 may be coupled to the right-side member 44 the frame 40. One or more slots 119 in the frame 40 allow the position of the tensioner 118 to be adjusted, thereby accommodating assembly tolerances and permitting adjustment to compensate for stretch of the takeoff belt 116. According to another embodiment, the tensioner 118 may include a resilient mechanism (e.g., a spring) to automatically respond to any additional slack or tension in the takeoff belt 116. According to other embodiments, the power takeoff pulley 69 may be coupled to an output shaft of the motor assembly 24 adjacent the drive motor pulley 66 or opposite the motor 102 from the drive motor pulley 66, or the power takeoff pulley 69 may be coupled to the front shaft 54 of the front shaft assembly 50. In such embodiments, the transmission 100 may not include a reverse shaft assembly 110 to correct the rotational direction of the motive force.

Figure 34:
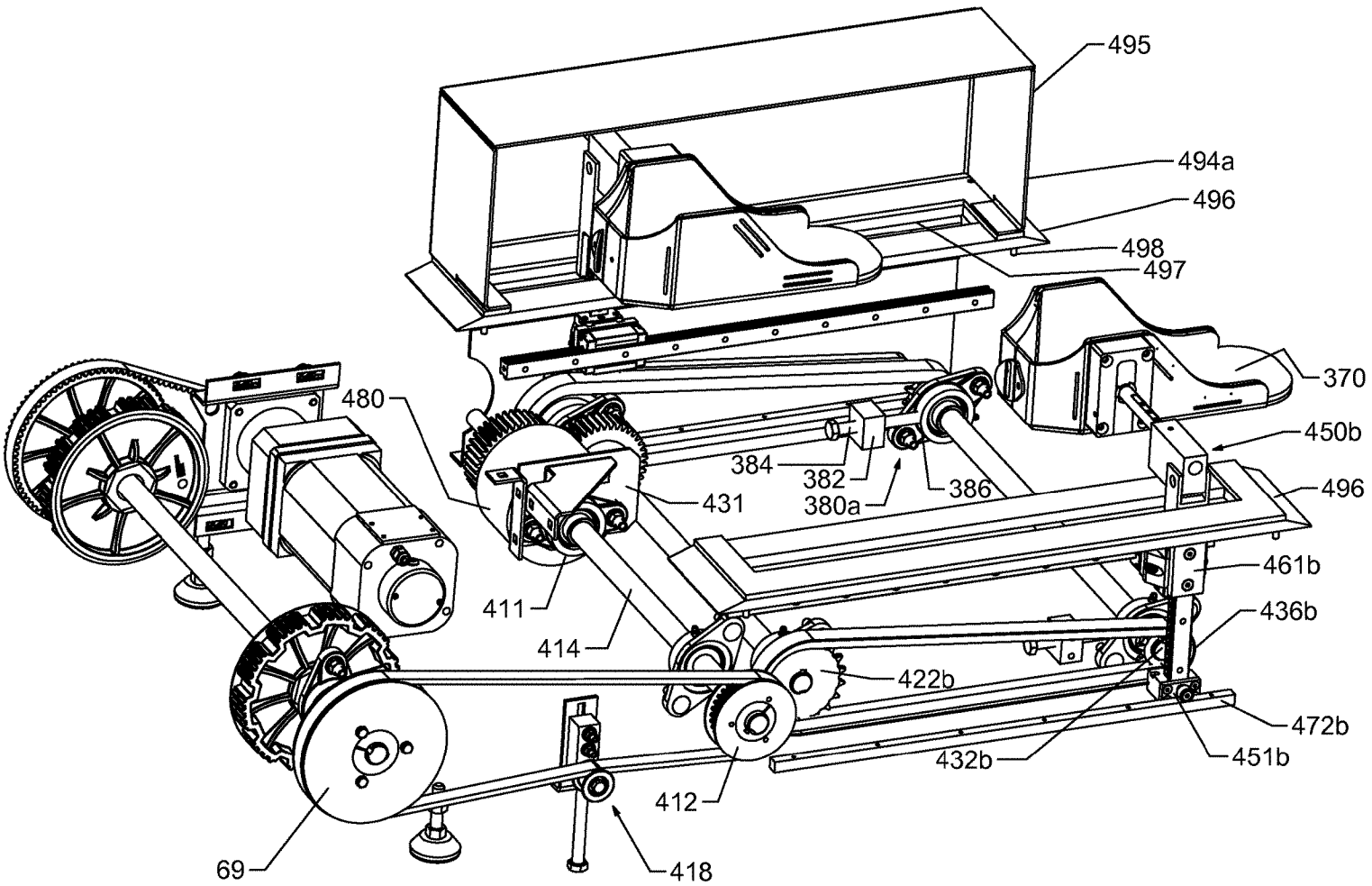
FIG. 34 is a top, right-side, rear perspective view of a portion of the components of the treadmill of FIG. 30, shown according to an exemplary embodiment.
Figure 36:
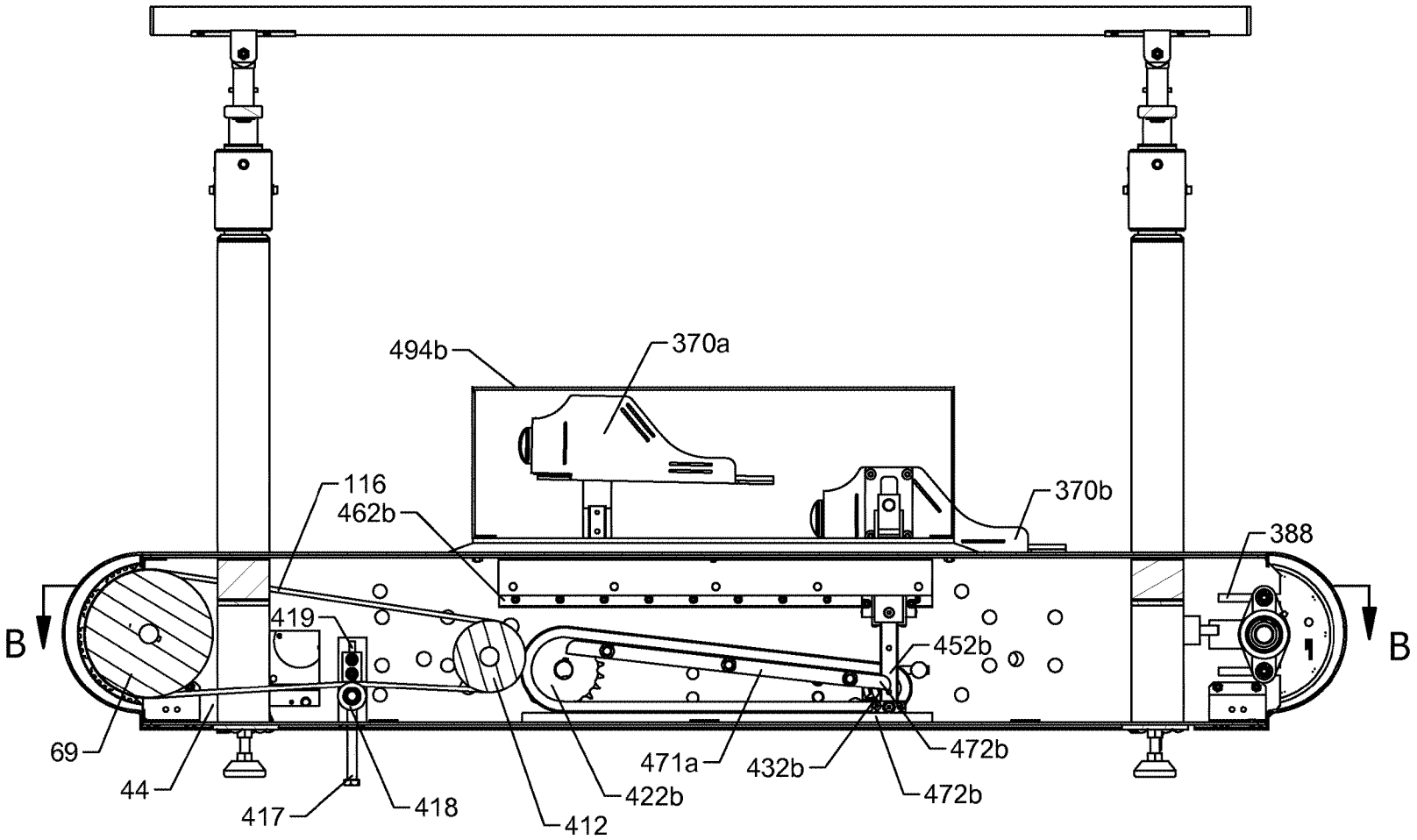
FIG. 36 is a right-side elevation view of a portion of the components of the treadmill of FIG. 30, shown according to an exemplary embodiment.

Referring to FIGS. 34 and 36, a tensioner 418 is shown according to an exemplary embodiment. The tensioner 418 may be coupled to the right-side member 44 of the frame 40. One or more slots 419 in the frame 40 allow the position of the tensioner 418 to be adjusted so that the tensioner 418 pushes upward on a bottom portion of the takeoff belt 116, thereby accommodating assembly tolerances and permitting adjustment to compensate for stretch of the takeoff belt 116. An adjustment screw 417 may be threaded through a bottom portion of the frame 40 or a nut coupled to the frame 40 such that the end of the screw pushes against the tensioner 418. Accordingly, advancement of the screw 417 causes increased tension on the takeoff belt 116, and retraction of the screw 417 causes reduction of the tension on the takeoff belt 116.

Figure 18:
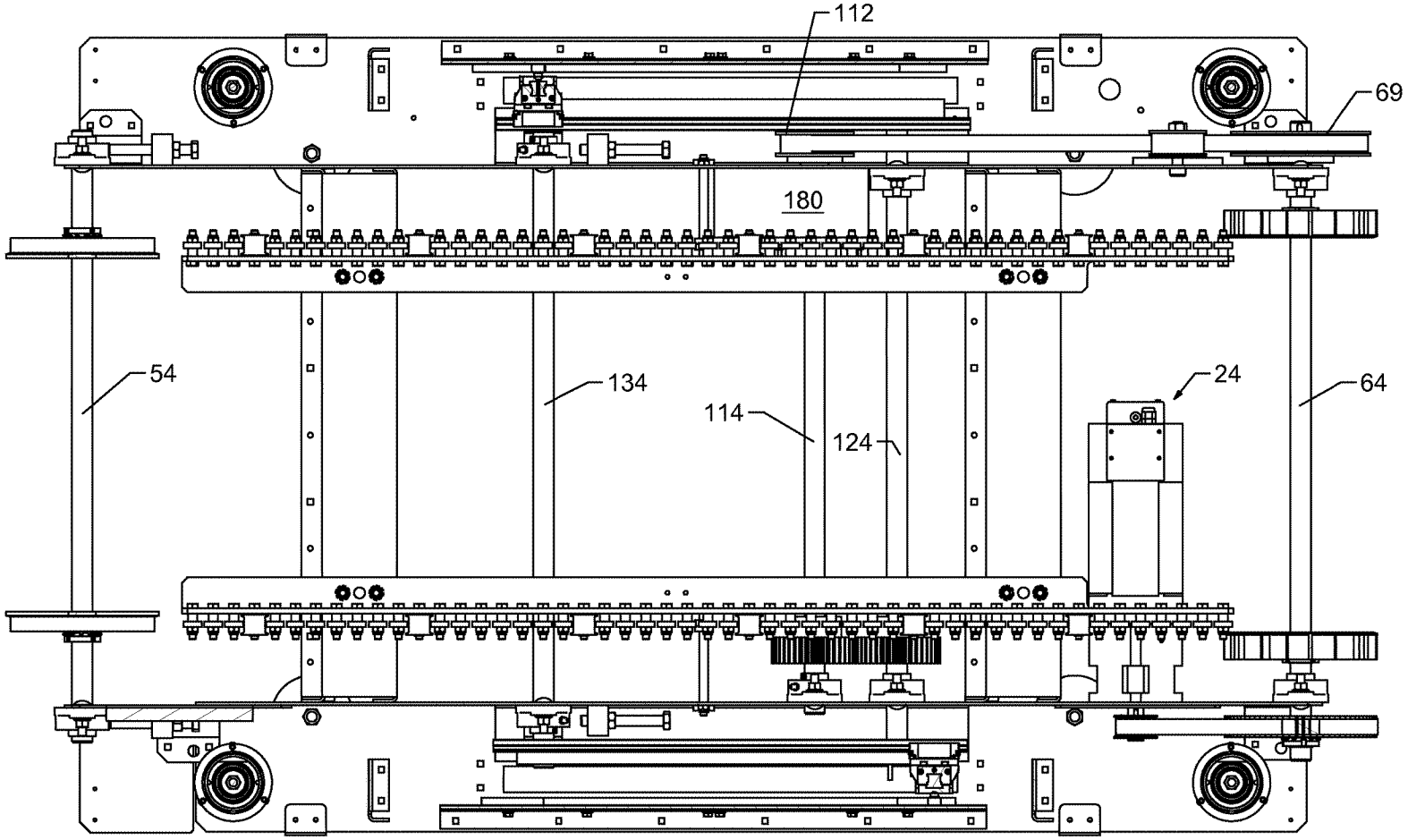
FIG. 18 is a top plan sectional view of a portion of the components, and with the walking belt removed, of the treadmill of FIG. 2 through lines A-A of FIG. 14, shown according to another exemplary embodiment.
Figure 19:
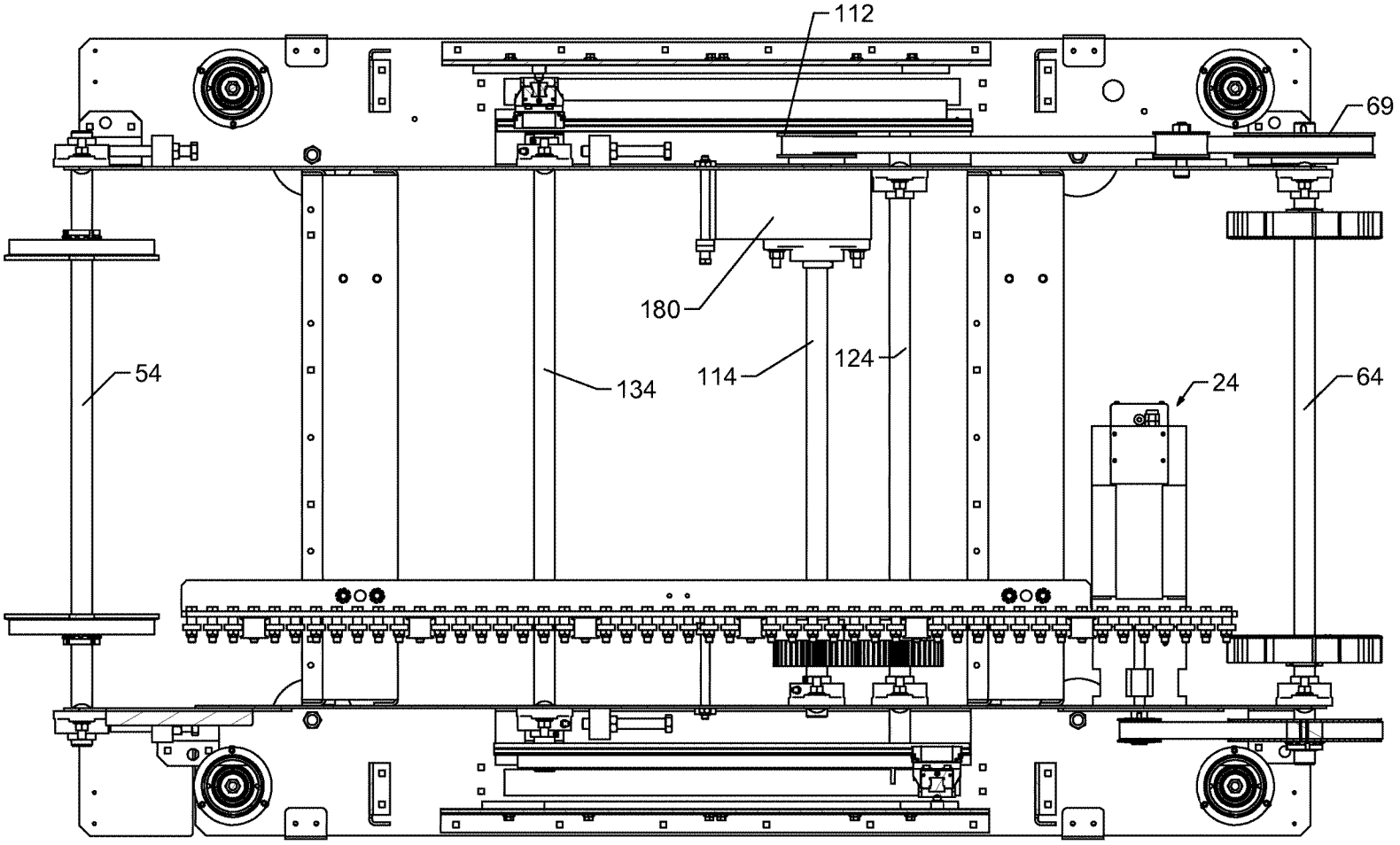
FIG. 19 is a top plan sectional view of a portion of the components of the treadmill of FIG. 18, shown according to an exemplary embodiment.
Figure 20:
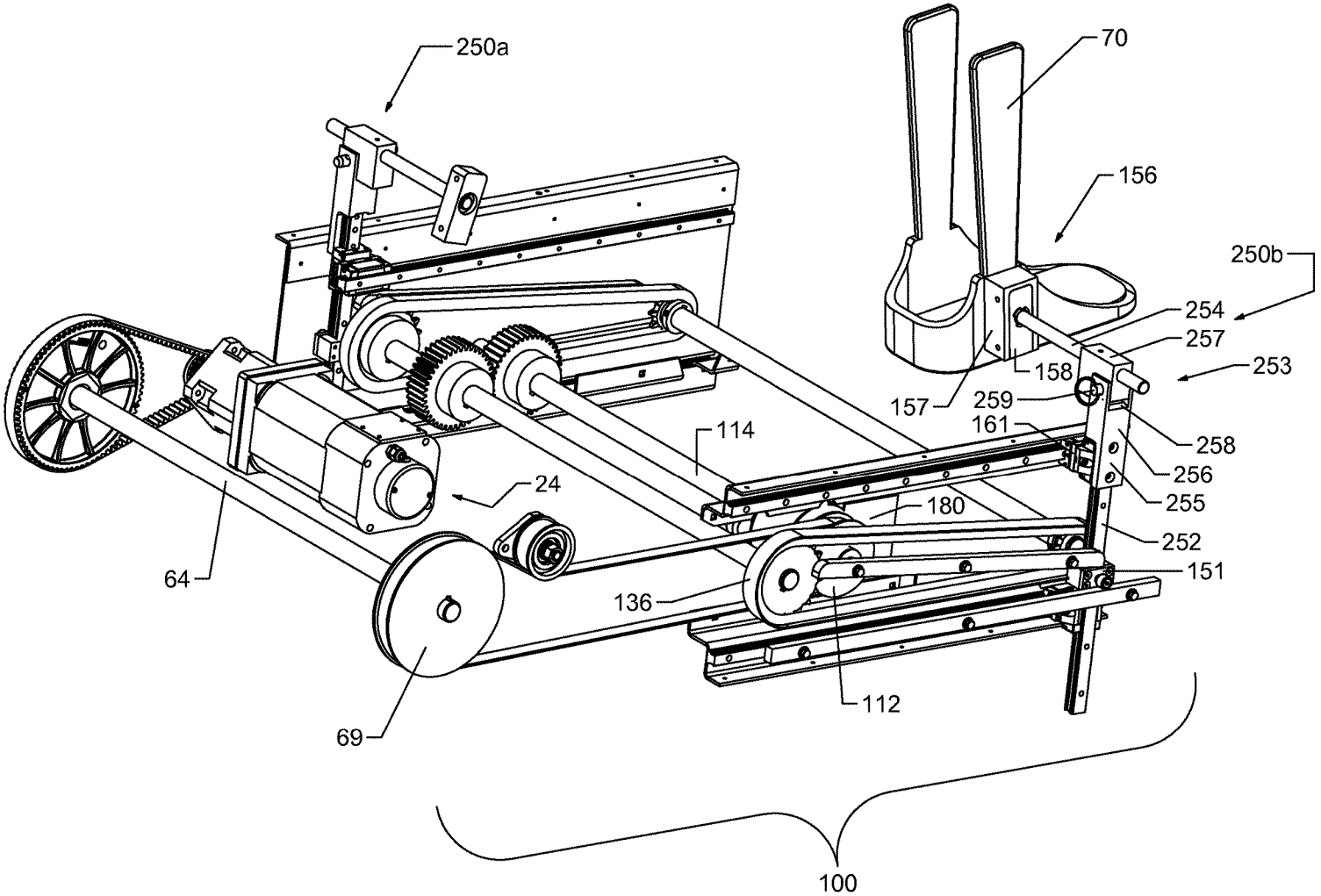
FIG. 20 is a top, right-side, rear perspective view of a portion of the components of the treadmill of FIG. 18, shown according to an exemplary embodiment.

Referring briefly to FIGS. 18-20, the transmission 100 may include a clutch 180 that allows the follower assembly 150, 250 to be selectively coupled and decoupled from the motor assembly 24. When the clutch 180 is in a first state (e.g., engaged, coupled, clutched, etc.), motion is transferred from the motor assembly 24 to the user engagement structure 70, and when the clutch 180 is in a second state (e.g., disengaged, decoupled, declutched, etc.), motion is not transferred from the motor assembly 24 to the user engagement structure 70 via the transmission 100. According to one embodiment, the clutch 180 allows the motion of the walking rehabilitation device 16 to be decoupled from the motion of the walking belt 18. Decoupling the motion of the walking rehabilitation device 16 from the motion of the walking belt 18 using the clutch 180 facilitates use of the treadmill 10 without the walking rehabilitation device 16. The clutch 180 may be a variable clutch, which may be adjusted to allow or require a more advanced rehabilitee to provide a greater portion of the locomotive force. The clutch 180 may also be used in conjunction with an emergency stop system, described below.

According to the embodiment shown, the clutch 180 is a magnetic clutch located between pulley 112 and reverse shaft 114. For example, a rotor of the clutch 180 may be coupled to the pulley 112, and an armature of the clutch 180 may be coupled to the reverse shaft 114. Thus, when the clutch 180 is energized, the clutch 180 engages, and torque may be transferred from the pulley 112 to the reverse shaft 114. The clutch 180 may be controlled by a user input device (e.g., switch, button, knob, lever, touchscreen interface, etc.) on the control panel 26, 27. According to other embodiments, the clutch 180 may be controlled by processing electronics coupled to the control panel 26, 27. According to various embodiments, the clutch 180 may be a mechanical or hydraulic clutch, or may be located in another position, for example, between the rear shaft 64 and the power takeoff pulley 69.

Returning to FIGS. 4-17, as noted above, the drive shaft assembly 120 is configured to receive the motive force from the reverse shaft assembly 110. The drive shaft assembly 120 includes at least one, preferably a pair of first or rear sprockets 122, shown as left-side rear sprocket **122*a* and right-side rear sprocket 122*b*, and a gear 123 interconnected with, and preferably mounted, a shaft, shown as a drive shaft 124**.

The idler shaft assembly 130 supports and defines the path 140 of the chain 136 and includes a pair of second or forward sprockets 132, shown as left-side forward sprocket **132*a* and right-side forward sprocket 132*b*, interconnected with, and preferably mounted on, a shaft, shown as an idler shaft 134. A pair of belts or chains 136, shown as left-side chain 136*a* and right-side chain 136*b*, extends between and operably couples the rear sprockets 122 and the forward sprockets 132. A pin 138, shown a left-side pin 138*a* and a right-side pin 138*b*, is coupled to each of the chains 136**.

According to the exemplary embodiment shown, the rear shaft 64 rotates in the direction of the walking belt 18 as it is driven by the motor assembly 24 so that the power takeoff pulley 69 coupled to the rear shaft 64 also rotates in the same direction. Power is transmitted from the power takeoff pulley 69 to the reverse shaft 114 via the pulley 112 and the takeoff belt 116. However, the reverse shaft is rotating in the opposite direction as the walking belt 18. Power is transferred across the reverse shaft 114 to the gear 113, which is engaged with gear 123 of the drive shaft assembly 120. The engagement of the gears 113, 123 causes the drive shaft assembly 120 to rotate opposite the reverse shaft assembly 110 (i.e., in the same direction as the rear shaft assembly 60 and the walking belt 18). The rear sprockets 122, in turn, cause the chains 136 to follow cyclical paths 140, shown as left-side path **140*a* and right-side path 140*b*, that travel or rotate in the same direction as the walking belt 18. Accordingly, the pins 138 follow the cyclical paths 140. According to some embodiments, the cyclical path may have an ovoid, elliptical, or teardrop shape. According to the exemplary embodiment shown, the cyclical path has a racetrack shape. According to another embodiment, the treadmill does not include a reverse shaft assembly 110, instead having the pulley 112 mounted to the drive shaft 124, and the takeoff belt 116 being fully twisted between the power takeoff pulley 69 and the pulley 112 to cause the drive shaft assembly 120 to rotate in the same direction as the rear shaft assembly 60**.

Referring to FIGS. 30-34, a transmission 400 is shown, according to an exemplary embodiment. The rear shaft 64 rotates in the direction of the walking belt 18 as it is driven by the motor assembly 24 so that the power takeoff pulley 69 coupled to the rear shaft 64 also rotates in the same direction. Power is transmitted from the power takeoff pulley 69 to the reverse shaft 414 via the pulley 412 and the takeoff belt 116. However, the reverse shaft is rotating in the opposite direction as the walking belt 18. Notably, the reverse shaft assembly 410 and the drive shaft assembly 420 have switched positions relative to the transmission 100. Because the reverse shaft assembly 410 is aft of the drive shaft assembly, the takeoff pulley 69, takeoff belt 116, and the pulley 412 can be moved outboard of the rear sprocket 422 and chain 436*b* without interfering with the guide assembly 460. Moving the chains 436 and the guide assemblies 460 inboard reduces the lateral distance between the guide assemblies 460 and the user engagements structures 370. The reduced lateral distance allows for a more compact walking rehabilitation device 316 (thus providing more room for a therapist) and reduces the length of a lateral member 454. The reduced length of the lateral member 454 results in less bending stress on the lateral member 454.

Power is transferred across the reverse shaft 414 to the gear 413, which is engaged with gear 423 of the drive shaft assembly 420. The engagement of the gears 413, 423 causes the drive shaft assembly 420 to rotate opposite the reverse shaft assembly 410, that is, in the same direction as the rear shaft assembly 60 and the walking belt 18. The rear sprockets 422, in turn, cause the chains 436 to follow cyclical paths that travel or rotate in the same direction as the walking belt 18. According to some embodiments, the cyclical path may have an ovoid, elliptical, or teardrop shape. According to the exemplary embodiment shown, the cyclical path has a racetrack shape.

The transmission 400 may include a clutch 480 that allows the follower assembly 450 to be selectively coupled and decoupled from the motor assembly 24. The clutch 480 may operate as described above with reference to clutch 180. As shown, the clutch 480 operably couples and decouples the reverse shaft 414 and the gear 413. A bracket 431 may be coupled to the cross-member 46 of the frame 40 to help support the weight of the clutch 480. For example, referring briefly, to FIG. 34, the bracket 431 is shown to support a bearing 411 that is coupled to the reverse shaft 414.

Returning to FIGS. 4-17, and as best seen in FIGS. 15 and 17, the cyclical paths 140 of the pins 138 includes a first or bottom portion 141 that travels in the same the direction as the walking surface 19 of the walking belt 18 and includes a third or top portion 143 that travels opposite the direction of the walking surface 19. A second or rear portion 142 of the path 140 transitions from the bottom portion 141 to the top portion 143 and includes an upward directional component. A fourth or front portion 144 of the path 140 transitions from the top portion 143 to the bottom portion 141 and includes a downward directional component. The transmission 100 is preferably configured (e.g., pulley ratios and gear ratios are selected such that) the rearward velocity of the pin 138 as it passes through the bottom portion 141 of the path 140 is equal to the rearward velocity of the walking surface 19 of the walking belt 18. According to various embodiments, additional idler sprockets may be used, for example, along the top portion 143, to refine the shape of the path 140. According to other embodiments, at least one of the rear sprocket 122 and forward sprocket 132 may have a substantially non-circular shape (e.g., oval, ovoid, elliptical, polygon, Reuleaux polygon, etc.) to refine the motion imparted to the rehabilitee.

The walking rehabilitation device 16 is further shown to include at least one follower assembly 150, according to an exemplary embodiment. The follower assemblies, shown as first or left-side follower assembly 150*a* and second or right-side follower assembly 150*b*, interconnect the pins 138 and the user engagement structures 70 and transfer motive forces therebetween. Accordingly, the cyclical motion of the pin 138 is transferred to the user engagement structure 70, which, in turn, imparts motion to the rehabilitee to simulate a gait (e.g., a desired gait, a walking gait, etc.). The left-side pin 138*a* and the right-side pin 138*b* are preferably coupled to each of the chains 136*a*, 136*b* 180-degrees out of phase with one another so that the user engagement structures 70 interconnected thereto will move in a synchronized manner to generate a bipedal gait.

According to the embodiment shown, the rear sprockets 122 are larger than the forward sprockets 132, which causes the path 140 to better approximate a natural gait. According to other embodiments, the front and rear sprockets 132, 122 may be of any size or relative size, and one or more additional sprockets may guide the chain 136 on a more complex path, for example, to simulate a different gait or to more exactly simulate a natural gait. The follower assemblies further allow the user engagement structures 70 to be spaced apart from the pins 138 so that, for example, the transmission 100 maybe located below and/or laterally outboard of the walking surface 19 while the user engagement structures 70 are located above the walking surface 19 and spaced laterally apart to provide for a substantially natural gait.

The follower assembly 150 is shown to include a follower 151 rotatably coupled to the pin 138, a joint or mount 156 removably coupled to the user engagement structure 70, and one or more members interconnecting the follower 151 and the mount 156. Rotatably coupling the follower 151 to the pin 138 allows the follower 151 to remain in an upright orientation relative to the treadmill 10 even though the pin 138 and chain 136 change orientation as they follow the cyclical path 140. According to the embodiment shown, the pin 138 is fixed to the chain 136, and the pin 138 is received by the follower 151. According to another embodiment, the pin is fixed to the follower 151, and the pin is received by the chain 136. According to another embodiment, the pin 138 is rotatably coupled to both the chain 136 and the follower 151.

As best seen in FIG. 5, according to one embodiment, the one or more members may be a single L-shaped member. As shown, the one or more members include a first or vertical member 152 (e.g., rod, beam, shaft, etc.) coupled to the follower 151, and a second or lateral member 154 coupled to the vertical member 152 at a joint 153. The lateral member 154 includes a first end portion coupled to the joint 153 and a second end portion distal the first end portion. The second end portion rotatably couples to a first portion of the mount 156, shown as block 158. The block 158 releasably couples to a second portion of the mount 156, shown as housing 157, which is fixed to the user engagement structure 70. According to the embodiment shown, the housing 157 may be releasably secured to the block 158 using one or more pins 159 passing through aligned holes 155 and 155' in the housing 157 and the block 158, respectively. Releasably coupling the user engagement structure 70 to the follower assembly 150 allows different sizes and types of user engagement structures to be used with the walking rehabilitation device 16, for example, user engagement structures having a stiffer or more flexible sole, no sole to enable barefoot walking, etc.

According to the embodiment shown, the joint 153 slides onto and along the vertical member 152. According to one embodiment, the joint 153 and vertical member 152 have a sliding fit relationship, allowing the fore-aft and vertical loads to be transferred from the vertical member 152 to the user engagement structure 70 via joint 153. The joint-over-post configuration allows a therapist to connect the user engagement structure 70, mount 156, lateral member 154, and joint 153 to the rehabilitee, and then to easily couple such an assembly to the transmission 100 by lowering the joint 153 onto the vertical member 152.

As shown, the joint 153 is not fixed or fastened to the vertical member 152. According to one embodiment, a detent of predetermined force may couple the joint 153 and the vertical member 152. The detent may provide positive feedback that the joint 153 is properly coupled to the vertical member 152. Further, a low detent force may inhibit accidental decoupling of the joint 153 from the vertical member 152, but may allow decoupling of the joint 153 from the vertical member 152 with sufficient force. For example, the joint-over-post configuration and/or detent may allow the rehabilitee to break free from the vertical member 152 if sufficient differential load is created between the user engagement structure 70 side of the joint 153 and the transmission 100 side of the joint 153, e.g., if a rehabilitee stumbles. According to another embodiment, in case of emergency, the rehabilitee may be simply lifted clear of the treadmill 10 with the body weight support system 34, with the joint 153 separating from the vertical member 152. In an embodiment with the clutch 180, an emergency stop system may stop the motor assembly 24 and decouple the clutch 180, with the joint 153 separating from the vertical member 152 as necessary.

Figure 21:
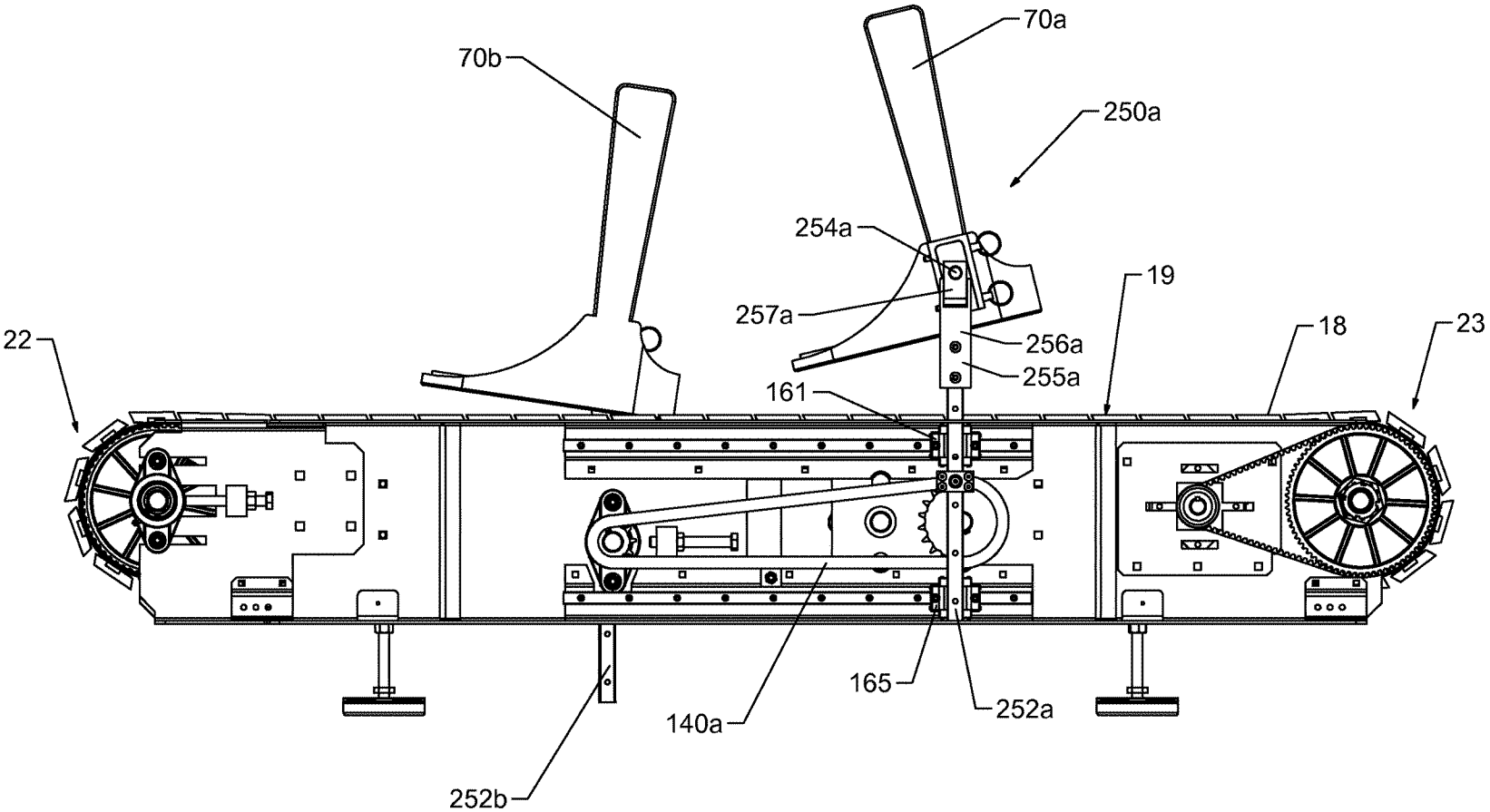
FIG. 21 is a left-side elevation view of a portion of the components of the treadmill of FIG. 18, shown according to an exemplary embodiment.
Figure 22:
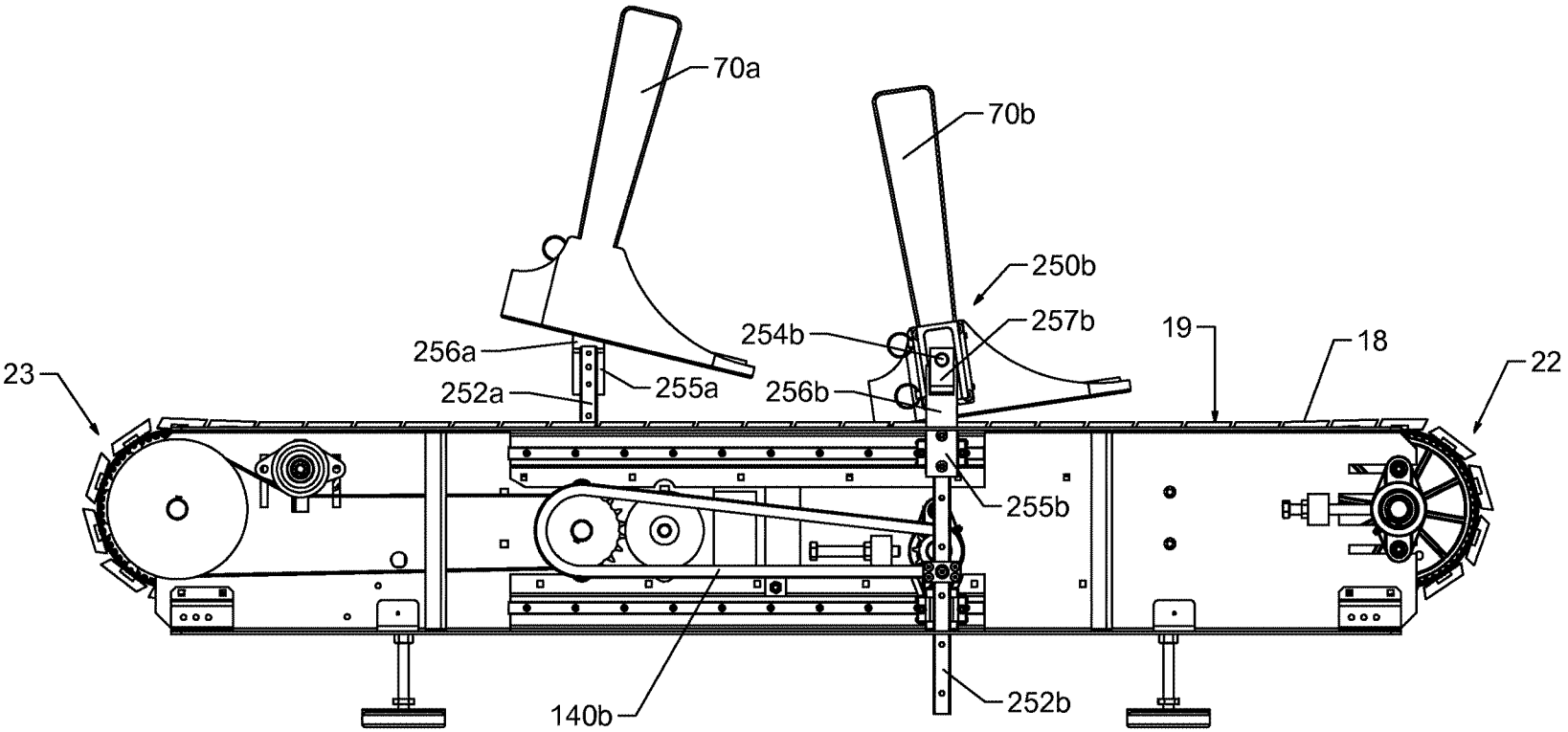
FIG. 22 is a right-side elevation view of a portion of the components of the treadmill of FIG. 18, shown according to an exemplary embodiment.

Briefly referring to FIGS. 20-22, another embodiment of a follower assembly, shown as follower assembly 250, is shown according to another exemplary embodiment. As shown, the follower assembly 250 includes a first or vertical member 252 coupled to the chain 136 via the follower 151. A joint 253 couples the vertical member 252 to a second or lateral member 254 which couples to the user engagement structure 70. The joint 253 includes a first portion 256, slidably coupled to the vertical member 252, and a second portion 257, selectively coupled to the lateral member 254. The first portion 256 is shown to include a flange 255 that extends downward, along the outboard side of the vertical member 252. Extending along the outboard side provides an area through which one or more fasteners may extend to fix the first portion 256 to the vertical member 252, without interfering with the top shuttle 161.

The first portion 256 is shown to include a slot 258 configured to receive at least part of the second portion therein, and, according to the embodiment shown, a pin 259 extends through the first portion 256 and the second portion 257 to connect the two portions of the joint 253. Such an assembly allows a therapist to connect the user engagement structure 70, mount 156, lateral member 254, and second portion 257 of the joint 253 to the rehabilitee and to then easily couple such an assembly to the transmission 100 by placing the second portion 257 of the joint 253 into the slot 258 of the first portion 256 of the joint 253.

According to various embodiments, the pin 259 may act as an axle or hinge, permitting the second portion 257 to rotate thereabout. Such rotation may allow a user or therapist to decouple the housing 157 from the block 158, and rotate the lateral member 154 upward and outward, clear of the space above walking belt 18. Such a configuration allows a therapist to quickly transition a rehabilitee from assisted to unassisted walking, and back again, if so desired.

According to another embodiment, the first portion 256 and the second portion 257 of the joint 253 may be coupled by a detent, for example, a resiliently biased (e.g., spring loaded, etc.) member (e.g., rod, ball, etc.) on one of the first portion 256 or the second portion 257, which engages a depression in the other of the first portion 256 or the second portion 257. As described above, a detent may provide positive feedback of coupling of the first portion 256 and the second portion 257, may facilitate quick coupling and decoupling of the first portion 256 or the second portion 257, and may allow the first portion 256 to decouple from the second portion 257 in response to sufficient differential load between the user engagement structure 70 side of the joint 253 and the transmission 100 side of the joint 253, for example, if a rehabilitee stumbles.

Referring to FIGS. 25-29 and 33-34, another embodiment of a follower assembly, shown as follower assembly 450, is shown according to another exemplary embodiment. As shown, the follower assembly 450 includes a first or vertical member 452 coupled to the chain 436 via the follower 451. A joint 453 couples the vertical member 452 to a second or lateral member 454, which couples to the user engagement structure 370. The joint 453 includes a first portion 456, slidably coupled to the vertical member 452, and a second portion 457 selectively coupled to the lateral member 454. The first portion 456 is shown to include a flange 455 that extends downward, along the outboard side of the vertical member 452. Extending along the outboard side provides an area through which one or more fasteners may extend to fix the first portion 456 to the vertical member 452, without interfering with the shuttle 161.

The first portion 456 is shown to include a slot 458 configured to receive at least part of the second portion 457 therein, and a pin (not shown) extends through the first portion 456 and the second portion 457 to connect the two portions of the joint 453. Such an assembly allows a therapist to connect the user engagement structure 370, mount 356, lateral member 454, and second portion 457 of the joint 453 to the rehabilitee, and to then easily couple such an assembly to the transmission 400 by placing the second portion 457 of the joint 453 into the slot 458 of the first portion 456 of the joint 453.

According to the exemplary embodiment shown, the lateral member 454 may be adjusted axially or laterally relative to the second portion 457 of the joint 453. As shown, the lateral member 454 may include a plurality of positions, shown as holes 390, spaced apart axially along a portion of the length of the lateral member 454, and the second portion 457 may include a hole 391 extending through a sidewall of the second portion 457. A fastener, shown as pin 397, extends through the hole 391 of the second portion 457 and into a selectively aligned hole 390 of the lateral member 454. Accordingly, the relative lateral position of the user engagement structure 370 on the walking belt 18 may be selectively adjusted to accommodate rehabilitees of varying sizes and needs. For example, the relative lateral spacing between the user engagement structure 370 and the second portion 457 (and thereby the follower 451) may be adjusted.

As shown, the lateral member 454 includes a first end portion coupled to the joint 453 and a second end portion, distal the first end portion, that rotatably couples to a first portion of the joint or mount 356, shown as block 358. The block 358 releasably couples to a second portion of the mount 356, shown as housing 357, which is fixed to the user engagement structure 370. The housing 357 at least partially defines a channel 393. The housing 357 may completely define the channel 393, or as shown, the housing 357 and the user engagement structure 370 may cooperatively define the channel 393. The channel 393 is shown to extend substantially vertically and to receive a flange 392 on the block 358. Accordingly, a rehabilitee may attach the user engagement structure 370 and then couple the user engagement structure 370 (e.g., step onto, etc.) the block 358. According to the embodiment shown, the housing 357 may be releasably secured to the block 358 using one or more fasteners or pins 359 passing through aligned holes 355 and 355' in the housing 357 and the block 358, respectively. Releasably coupling the user engagement structure 370 to the follower assembly 450 allows different sizes and types of user engagement structures to be used with the walking rehabilitation device 316, for example, user engagement structures having a stiffer or more flexible sole, no sole to enable barefoot walking, etc.

A detent mechanism may be used to couple the housing 357 to the block 358. According to one exemplary embodiment, the pins 359 may be resiliently coupled to the housing 357. According to another exemplary embodiment, the pins 359 may be one or more spring-loaded ball bearings configured to engage the holes 355' when the holes 355' and the spring-loaded ball bearings are aligned. Such a detent mechanism may provide positive feedback to the rehabilitee and/or therapist that the housing 357 is properly seated on the block 358 and may allow for rapid decoupling of the rehabilitee from the walking rehabilitation device 316, for example, in case of emergency. Because the rehabilitee's weight is acting downward on the housing 357, pushing the housing 357 onto the block 358, in normal usage, the detent mechanism need only be strong enough to prevent accidental or inadvertent decoupling.

The block 358 may be rotatably coupled and axially fixed to the lateral member 454. As shown, the block 358 is coupled to the lateral member 454 with a retention assembly 350. A clip 352 engages a slot or groove 351 on the lateral member 454 on the outboard side of the block 358. A washer or plug 353 passes over the lateral member 454 on the inboard side of the block 358. According to one embodiment, the plug 353 may frictionally (e.g., press fit, etc.) or threadably couple to the lateral member 454. According to the embodiment shown, a pin 354 extends through a hole 394 in the lateral member 454 inboard of the plug 353. The assembly of the clip 352, block 358, plug 353, and pin 354 is preferably sufficiently tight to prevent axial movement of the block 358 relative to the lateral member 454, while permitting rotational movement of the block 358 relative to the lateral member 454.

Returning to FIG. 5, releasably coupling the user engagement structure 70 to the follower assembly 150 further allows the user engagement structures to be removed from the treadmill 10 to enable the treadmill 10 to be used by an able-bodied user or a rehabilitee who does not need mechanical assistance or may just need gait assistance on one leg. To further facilitate the use of the treadmill 10 without the user engagement structures 70, the joints 153 may rotate to allow movement of the lateral members 154 from a position extending over the walking belt 18 to a position not extending over walking belt 18 (e.g., a substantially vertical position or a substantially fore-aft position).

According to one embodiment, the follower assembly 150 may include a variable support system. For example, the vertical member 152 may be resiliently or springedly coupled to the follower 151. According to another example, the lateral member 154 may be resiliently or springedly coupled to the block 158. The variable support system allows limited range of movement of the user engagement structure 70 relative to the pin 138. Accordingly, when the pin 138 follows the rear portion 142 of the path 140, the variable support system would absorb (e.g., take up, compensate for, etc.) some of the initial upward motion of the pin 138; thus, the user engagement structure 70 would more gradually (not as immediately and suddenly) lift from the walking surface 19 of the walking belt 18. Similarly, when the pin 138 follows the front portion 144 of the path 140, the variable support system would absorb some of the final downward motion of the pin 138 (e.g., between the point where the pin 138 begins travel in a rearward direction and the point where the pin 138 ceases downward travel, between the forwardmost point of the path 140 and the bottommost point of the path 140, between a point proximate a forwardmost point of the second sprocket 132 and a point proximate the bottom of the second sprocket 132, etc.); thus, enabling the user engagement structure 70 to contact the walking surface 19 at approximately the same time that the user engagement structure 70 begins rearward motion. According to various embodiments, the follower assembly 150 may include a lateral drive system and/or an ankle articulation system in order to provide a more detailed or natural walking motion. An exemplary lateral drive system and ankle articulation device are shown and described in U.S. patent application Ser. No. 12/757,725 to Bayerlein et al., incorporated by reference herein in its entirety.

According to another embodiment, the follower assembly may include a mechanism to limit or constrain the rotational angle of the user engagement structure 70 relative to the vertical member 152 and the walking surface 19. For example, the lateral member 154 may have a cam portion, and mount 156 or joint 153 may include one or more plates adjacent the cam portion to limit the rotation thereof. For example, the cam portion may include a lobe that contacts one of the plates at a predetermined angle or rotation and prevents further rotation beyond the predetermined angle. Limiting the possible rotation (e.g., plantar flexion, dorsiflexion, etc.) of the user engagement structure 70 may prevent hyperextension by the rehabilitee as the rehabilitee steps forward or may prevent the rehabilitee from planting on walking belt 18 toe-first.

Referring to FIGS. 25-29 the follower assembly 450 may include a retention assembly 350 that includes a pin 354 extending at least partially through the lateral member 454. The portion of the pin 354 extending from the lateral member 454 is disposed in a cavity 395 defined by the block 358. The cavity 395 is at least partially defined by surfaces 396, 396' extending radially from a point proximate the longitudinal axis of the lateral member 454. (The point may be offset from the axis, for example, to compensate for the thickness of the pin 354.) Rotation of the lateral member 454 in a first direction (e.g., clockwise, counter-clockwise, etc.) is stopped when the pin 354 contacts a first of the surfaces 396. Rotation of the lateral member 454 in a second direction (e.g., counter-clockwise, clockwise, etc.) is stopped when the pin 354 contacts a second of the surfaces 396'. Accordingly, the angle between cooperating surfaces 396, 396' may be selected to limit the possible rotation of the user engagement structure 370 to a desired range.

The walking rehabilitation device 16 is further shown to include a guide assembly 160, according to an exemplary embodiment, to maintain the follower 151 and vertical member 152 in a substantially upright orientation. That is, the guide assembly 160 limits the range of motion or degrees of freedom of the follower assembly 150. The guide assembly 160 is shown to include a first or top shuttle 161 (e.g., slider, guide, etc.). The top shuttle 161 is slidably coupled to the vertical member 152 such that the vertical member 152 may slide or translate substantially vertically relative to the top shuttle 161. The top shuttle 161 is also slidably coupled to a first or top rail 162 (e.g., rail, etc.) such that the top shuttle 161 may slide or translate substantially horizontally in a fore-aft direction along the top rail 162. The top rail 162 is shown to be interconnected to the outer surface 49 of the respective side member 42, 44 of the frame 40 by a bracket 163. The bracket 163 may include a top laterally extending flange 164, which shields the top shuttle 161 and top rail 162 from debris. By constraining points other than the follower 151 along the vertical member 152, the guide assembly 160 can maintain the vertical member in a substantially upright orientation, thereby facilitating transmission of vertical forces from the walking rehabilitation device 16 to the rehabilitee.

The guide assembly 160 is shown to further include a second or bottom shuttle 165 (e.g., slider, guide, etc.). The bottom shuttle 165 is slidably coupled to the vertical member 152 such that the vertical member 152 may slide or translate substantially vertically relative to the bottom shuttle 165. The bottom shuttle 165 is also slidably coupled to a second or bottom rail 166 (e.g., rail, etc.) such that the bottom shuttle 165 may slide or translate substantially horizontally in a fore-aft direction along the bottom rail 166. The bottom rail 166 is shown to be interconnected to the outer surface 49 of the respective side member 42, 44 of the frame 40 by a bracket 167. The bracket 167 may include a bottom laterally extending flange 168, which shields the bottom shuttle 165 and bottom rail 166 from debris. By constraining additional points along the vertical member 152, the guide assembly 160 can maintain the vertical member in a substantially upright orientation, while reducing torque on each of the shuttles 161, 165, thereby reducing sticking or binding of the shuttle 161, 165 along the rail 162, 166. According to other embodiments, the guide assembly 160 may only include a top shuttle 161 and a top rail 162 (see, e.g., FIGS. 33-36, discussed below) may only include a bottom shuttle 165 and a bottom rail 166, may include multiple shuttles and/or rails above the follower 151, or may include multiple shuttles and/or rails below the follower 151.

Figure 10:
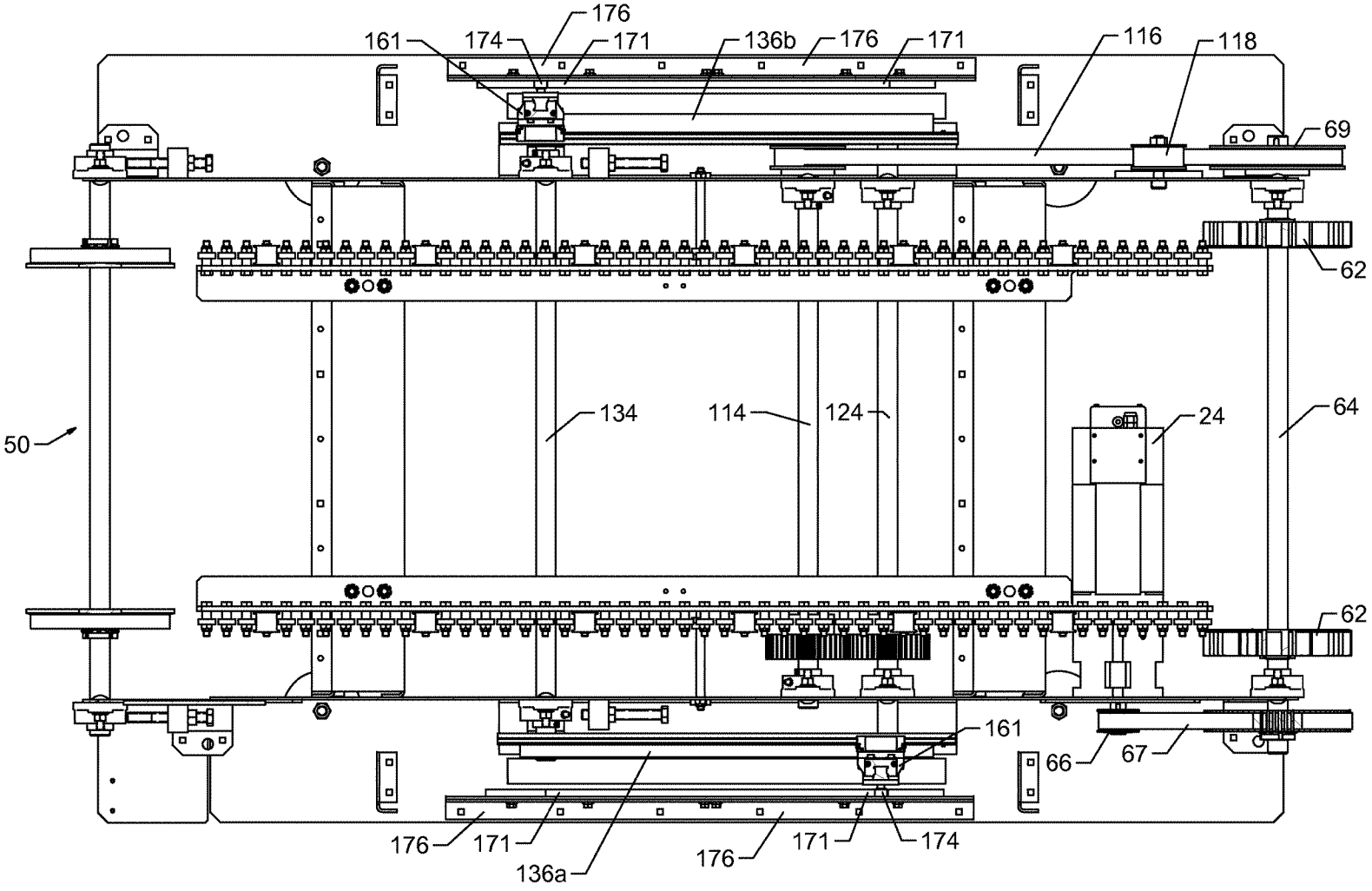
FIG. 10 is a top plan sectional view of a portion of the components, and with the walking belt removed, of the treadmill of FIG. 9 through lines A-A of FIG. 14, shown according to an exemplary embodiment.
Figure 11:
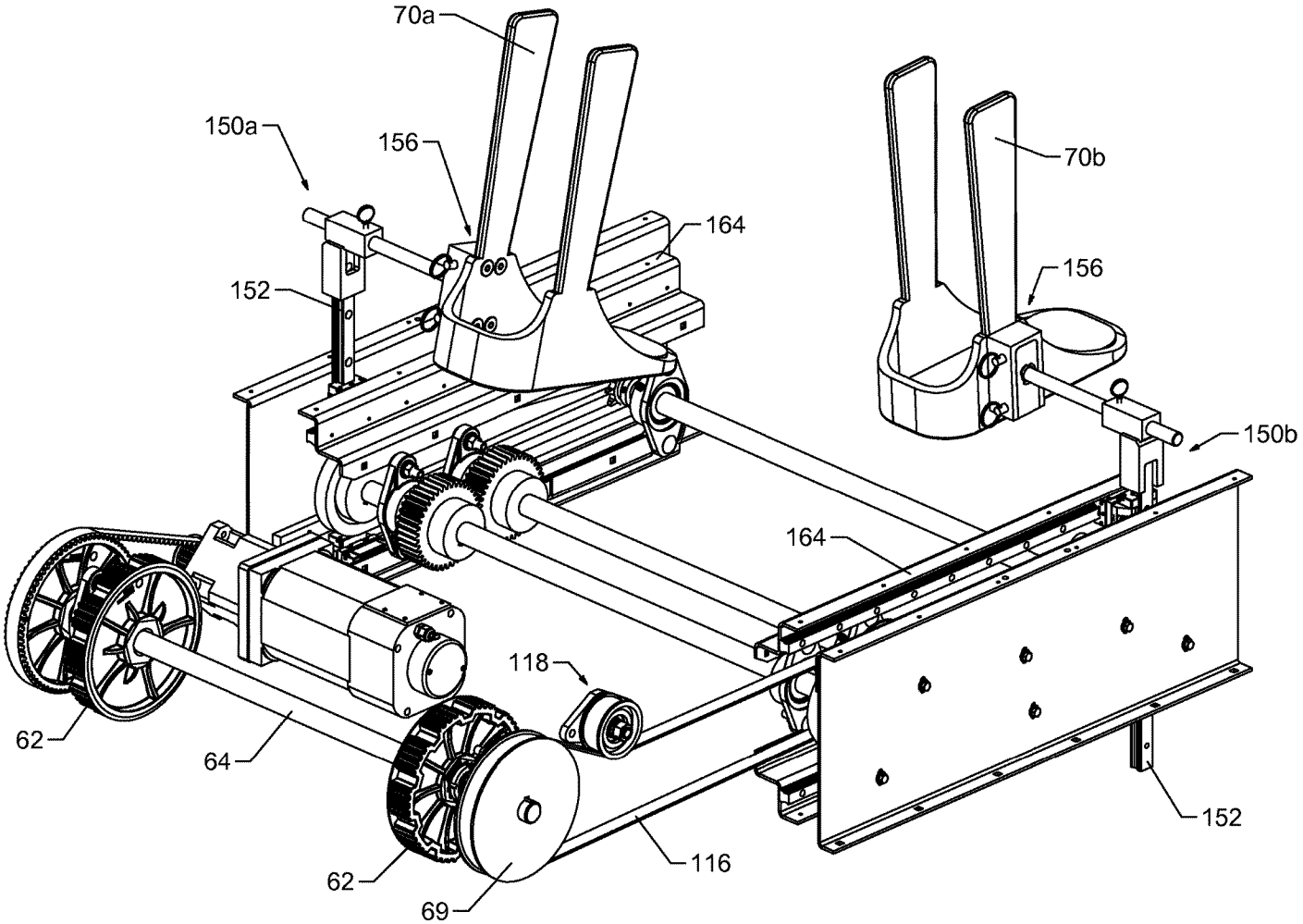
FIG. 11 is a top, right-side, rear perspective view of a portion of the components of the treadmill of FIG. 2, shown according to an exemplary embodiment.
Figure 12:
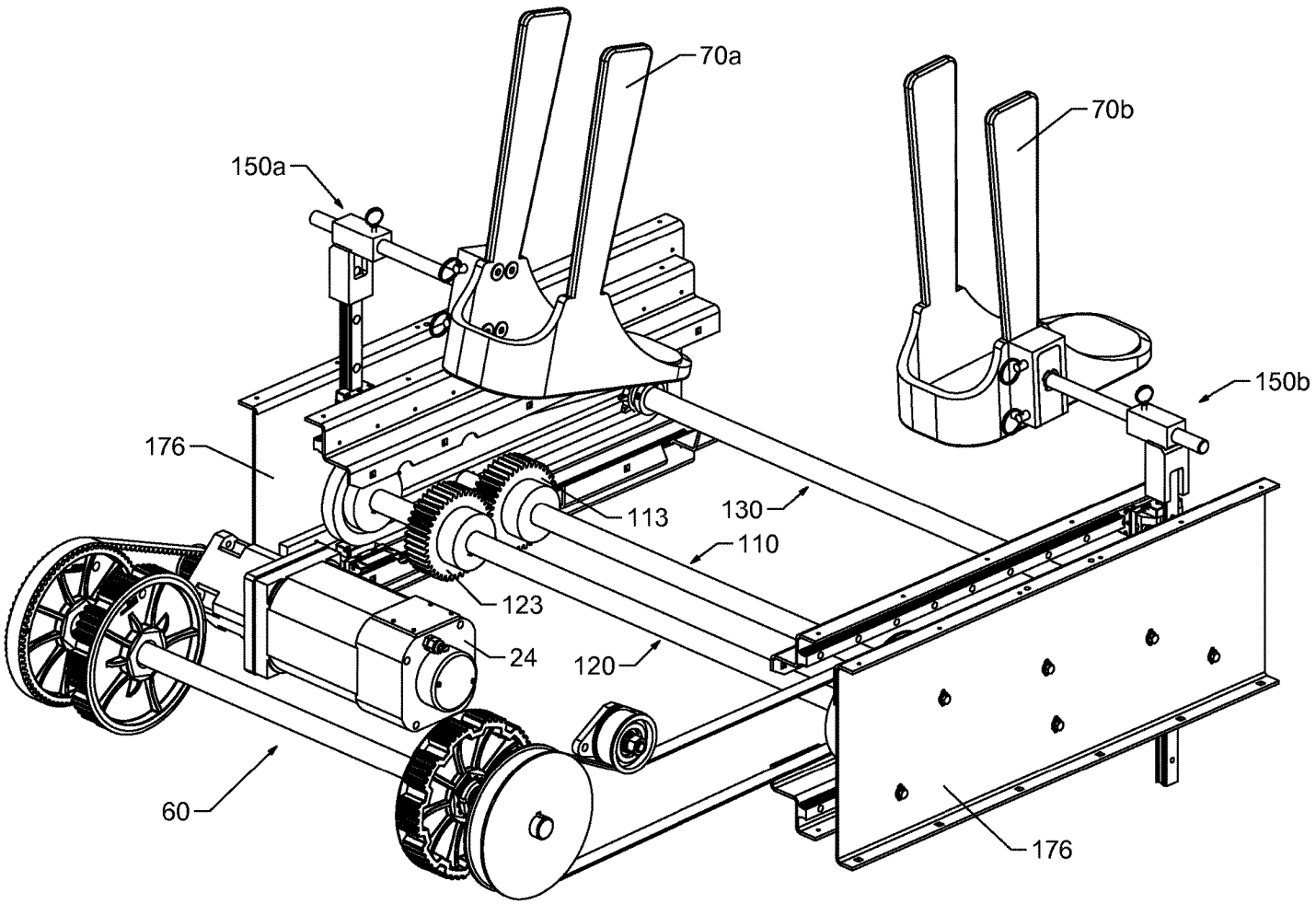
FIG. 12 is a top, right-side, rear perspective view of a portion of the components of the treadmill of FIG. 11, shown according to an exemplary embodiment.

The walking rehabilitation device 16 is further shown to include a load bearing assembly 170, best seen in FIGS. 5, 10, and 13, according to an exemplary embodiment. The load bearing assembly 170 includes a first or top rail 171, which is shown to be supported by a wall 176 (e.g., flange, web, support, etc.). The load bearing assembly 170 is further shown to include a second or bottom rail 172, which is also shown to be supported by the wall 176. The wall 176 is supported by the frame 40. As shown, the walls 176 extend between top and bottom flanges of the left-side member 42 and the right-side member 44, being supported thereby and providing structural support thereto in response to loads applied to the frame 40. The walls 176 may further shield the components of the walking rehabilitation device from debris or unintentional contact by a rehabilitee or therapist.

The load bearing assembly 170 further includes a boss 174 (e.g., pin, protrusion, cam follower, roller, etc.) coupled to the follower 151. When the pin 138 is in the top portion 143 of the path 140, the boss 174 rests on or slides along the top rail 171, thereby removing at least some of the vertical load (e.g., weight of the user engagement structure 70, weight of the rehabilitee R, etc.) from the chain 136. Similarly, when the pin 138 is in the bottom portion 141 of the path 140, the boss 174 rests on or slides along the bottom rail 172, thereby removing at least some of the vertical load (e.g., weight of the user engagement structure 70, weight of the rehabilitee R, etc.) from the chain 136. As the user engagement structure 70 contacts and is supported by the walking surface 19 of the walking belt 18 when the pin 138 is in the bottom portion 141 of the path 140, much, if not all, of the vertical load is supported by the walking belt 18. Thus, some embodiments may not include a bottom rail 172. According to another embodiment, the treadmill 10 does not include a load bearing assembly 170.

Referring to FIG. 13, a first transition surface 177, located at a first or rear end of the top rail 171, and a second transition surface 178, located at a second or front end of the top rail 171 are shown, according to an exemplary embodiment. The first and second transition surfaces 177, 178 are shown to be convex rounded ends of the top rail 171, but other embodiments may be concavely, linearly (e.g., chamfered), or curvilinearly contoured. The first transition surface 177 is contoured to guide and lift the boss 174 onto the top rail 171 and to prevent snagging or jamming of the boss 174 against a front end of the top rail 171. The second transition surface 178 is contoured to guide the boss 174 off of the top rail 171 and to prevent sudden or abrupt motion of the boss 174 as the vertical load from the follower assembly 150 changes from being supported by the top rail 171 to the chain 136. A sudden drop of the follower 151 as the boss 174 leaves the top rail 171 until the weight from the follower assembly 150 is supported by the chain 136 can increase wear on the walking rehabilitation device 16 and be discomforting to the rehabilitee. When the treadmill is run in a reverse direction, the second transition surface 178 guides and lifts the boss 174 onto the top rail 171, and the first transition surface 177 guides the boss 174 off of the top rail 171. Because the boss 174 descends onto and lifts off of the bottom rail 172, transitions surface similar to those of the top rail 171 are not necessary. According to other embodiments, the bottom rail 172 may include transition surfaces.

According to one embodiment, the top rail 171 is higher than the natural or catenary path of the chain 136 between the rear and front sprockets 122, 132 when the pin 138 is in the top portion 143 of the path 140, thereby ensuring that the weight of the user engagement structure 70, weight of the rehabilitee R, etc., transferred via the follower assembly 150 is substantially supported by the top rail 171. Similarly, according to one embodiment, the bottom rail 172 is higher than the natural or catenary path of the chain 136 between the rear and front sprockets 122, 132 when the pin 138 is in the bottom portion 141 of the path 140.

According to another embodiment, the transmission 100 and the vertical member 152, 252 may be configured to facilitate use of the treadmill 10 without the assistance from the walking rehabilitation device 16 to the rehabilitee. For example, portions of the transmission 100 (e.g., reverse shaft assembly 110, drive shaft assembly 120, idler shaft assembly 130, etc.) may be positioned lower relative to the walking surface 19. Referring to FIGS. 10 and 18-19, the pulleys 112 and sprockets 122, 132 of the transmission are generally located outside the width of the walking belt 18, allowing portions of the transmission 100 to be moved downward without interfering with the walking belt 18. According to another embodiment, idler pulleys (not shown) may be placed generally between the front and rear belt pulleys 52, 62 such that the bottoms of the idler pulleys guide the bottom portion of the walking belt 18 downward to provide greater clearance for the transmission 100 to be positioned farther downward. Moving the transmission 100 downward facilitates moving the top rail 162 downward and reduces the portion of vertical member 152, 252 that extends above the walking surface 19. Accordingly, when the treadmill 10 is configured for use without the walking rehabilitation device 16 (e.g., the lateral member 154, 254 is decoupled from the vertical member 152, 252), less of the vertical member 152, 252 remains above the frame 40, thereby facilitating access of a therapist to a rehabilitee. To compensate for the lower vertical member 152, 252, a portion of the joint 153 or (e.g., the first portion 256 of) the joint 253 make extend farther downward to couple to the vertical member 152, 252, thereby maintaining the lateral member 154, 254 at the same height relative to the walking surface 19. According to one embodiment, a portion of the joint 153, 253 may extend into the frame 40, below the plane of the walking surface 19. Furthermore, in an embodiment having clutch 180, the clutch 180 may be decoupled or disengaged such that the vertical members 152, 252 do not move while the walking belt 18 is moving.

According to another embodiment, the top rail 162 may be coupled to the outer surface 49 of the side members 42, 44 at an angle substantially parallel to the top 143 of the path 140. The top shuttle 161 may also be configured to support the vertical member 152, 252 at the substantially non-perpendicular angle relative to the top rail 162. Such a configuration requires less of the vertical member 152, 252 to extend above the top rail 162 in response to the difference in distance between the rear and front sprockets 122, 132, respectively.

Figure 29:
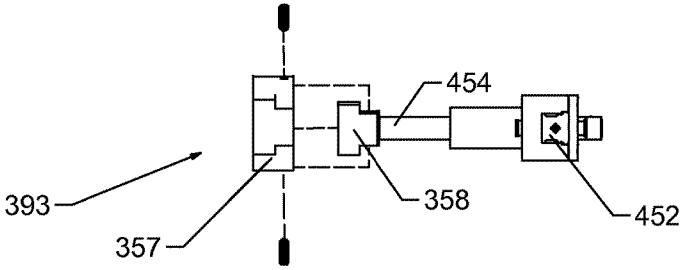
Figure 30:
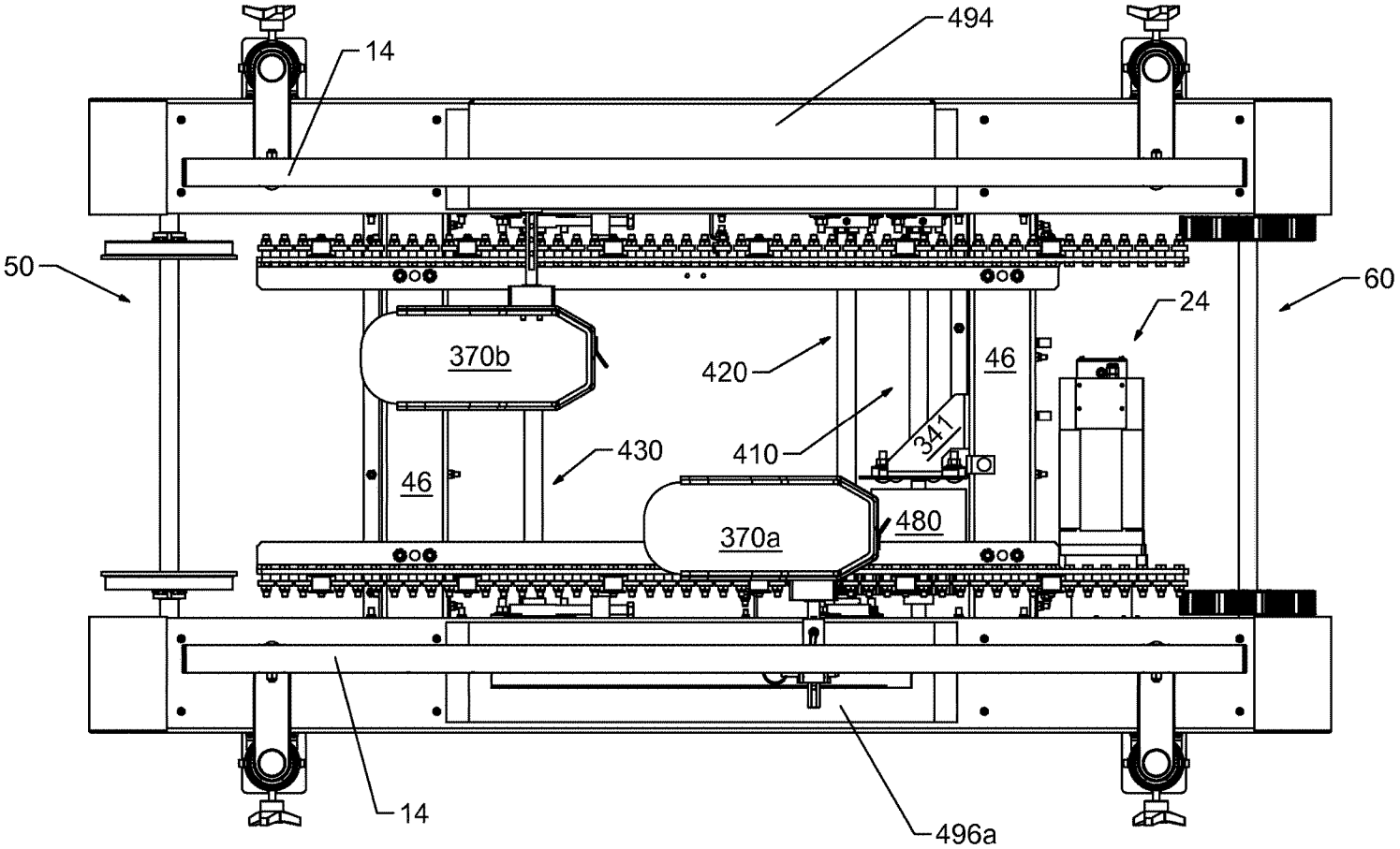
FIG. 30 is a top plan view of a portion of the components of the treadmill of FIG. 2, shown according to another exemplary embodiment.
Figure 31:
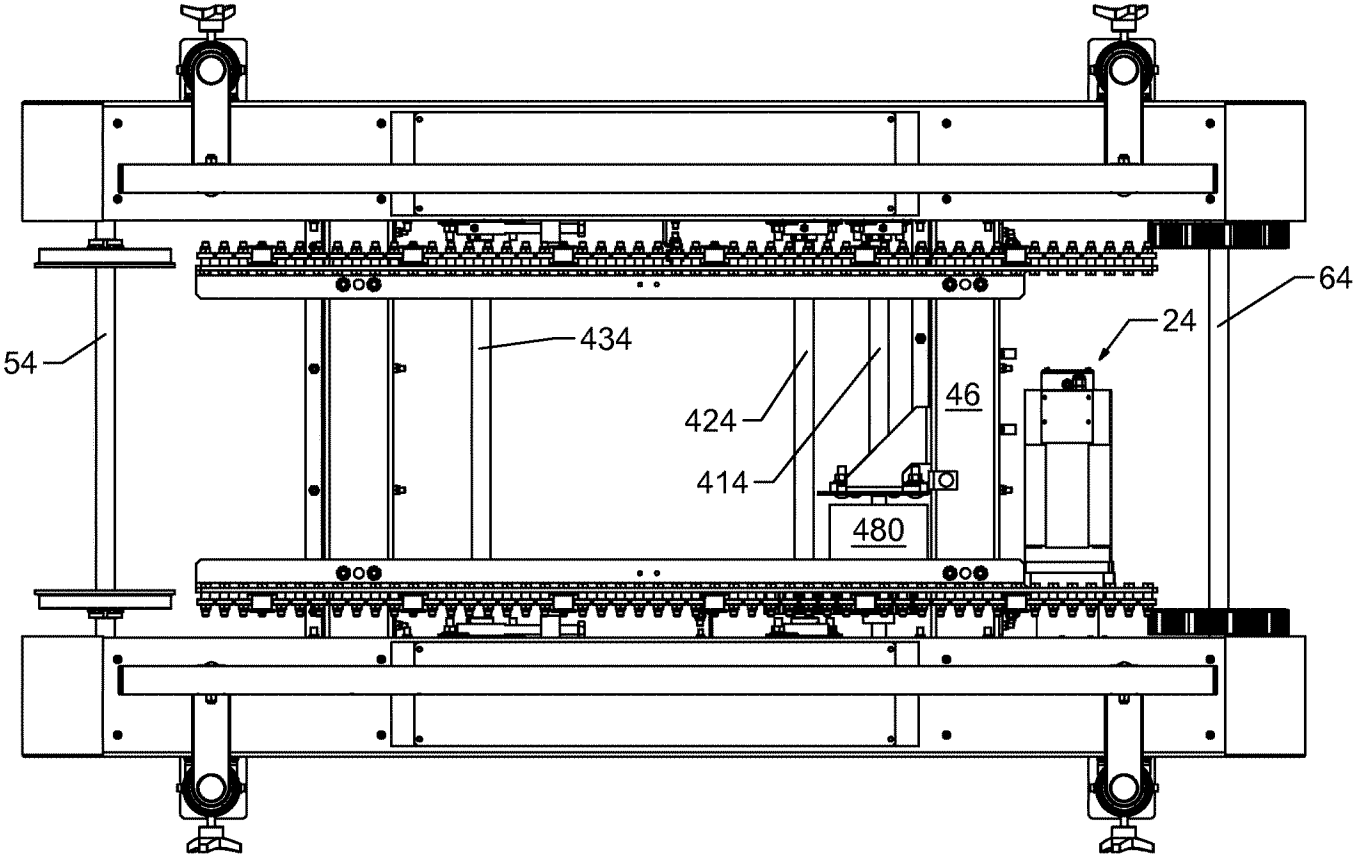
FIG. 31 is a top plan view of a portion of the components of the treadmill of FIG. 30, shown according to an exemplary embodiment.
Figure 32:
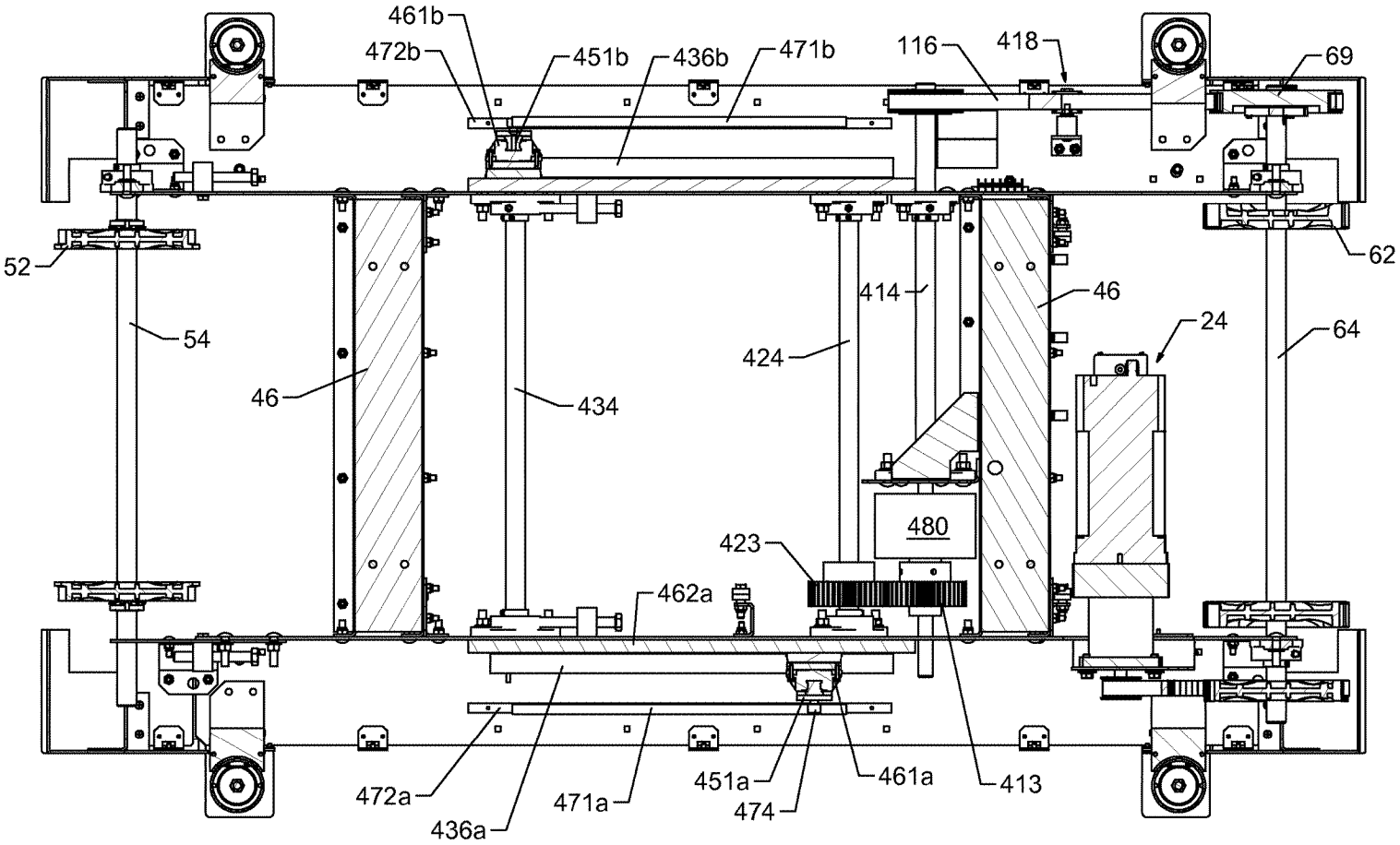
FIG. 32 is a top plan sectional view of a portion of the components, and with the walking belt removed, of the treadmill of FIG. 30 approximately through lines B-B of FIG. 36, shown according to an exemplary embodiment.

Referring to FIGS. 33-36, the transmission 400 includes a guide assembly 460 and a load bearing assembly 470, shown according to an exemplary embodiment. The guide assembly 460 includes a shuttle 461 having a first portion configured to translate along a rail 462. Because the chain 436 is now inboard of the takeoff belt 116, the rail 462 may be directly mounted to the side members 42, 44 of the frame 40, without a bracket 163. Directly mounting the rail 462 to the frame 40 allows a more compact walking rehabilitation device 316, and provides a more direct load transfer (i.e., stronger). The shuttle 461 also includes a second portion configured to slidingly receive the vertical member 452 such that the vertical member 452 may translate relative to the shuttle 461. Referring briefly to FIGS. 33 and 29, the vertical member 452 and the rail 462 are shown to define a channel extending along either side. The channels received arms or protrusions of the first and second portions of the shuttle 461, thereby permitting axial or longitudinal translation relative to the shuttle 461 and inhibiting rotational or lateral or transverse motion.

The guide assembly 460 is shown to not include a bottom shuttle 165 or bottom shuttle rail 166. Instead, the vertical member 452 is oriented based on the bottom end of the vertical member 452 being coupled to the follower 451 and based on the constrained translation of the vertical member 452 relative to the shuttle 461 and of the shuttle 461 relative to the rail 462. Not having a bottom shuttle 165 may require a stronger (e.g., larger, thicker, stronger material, etc.) vertical member 452. However, not having the vertical member 452 extend past the follower 451 facilitates the vertical member 452 does not extend below the frame 40 (cf. FIGS. 15-17). Accordingly, the frame 40 and, therefore, the walking surface 19 may be moved closer to the ground, thereby facilitating access to the treadmill 10 by a rehabilitee.

The load bearing assembly 470 includes a first or top rail 471, which may be supported by a wall 176 (e.g., flange, web, support, etc.) (see, e.g., FIG. 4). The load bearing assembly 470 is further shown to include a second or bottom rail 472, which may be supported by the wall 176 or by the bottom flanges 43 of the left-side member 42 and the right-side member 44 of the frame 40. The load bearing assembly 470 further includes a boss 474 (e.g., pin, protrusion, cam follower, roller, etc.) coupled to the follower 451. When the pin 138 is in the top portion 143 of the path 140, the boss 474 rests on or slides along the top rail 471, thereby removing at least some of the vertical load (e.g., weight of the user engagement structure 370, weight of the rehabilitee R, etc.) from the chain 436. Similarly, when the pin 138 is in the bottom portion 141 of the path 140, the boss 474 rests on or slides along the bottom rail 472, thereby removing at least some of the vertical load (e.g., weight of the user engagement structure 370, weight of the rehabilitee R, etc.) from the chain 436. Locating the bottom rail 472 on the flange 43 provides a more direct transfer of loads to the frame 40 and reduces the stresses on the wall 176. Locating the bottom rail 472 on the flange 43 also facilitates lowering the transmission 400 relative to the frame 40, which allows less of the vertical member 452 to extend above the walking surface 19. Having less of the vertical member 452 extend above the walking surface 19 facilitates use of the treadmill 10 without the user engagement structures 370 and follower assembly 450.

Referring to FIG. 34, the transmission 400 may include an adjustment system 380. The adjustment system 380 includes an adjustment screw 382, a threaded block 384 (e.g., nut, etc.) fixed to the frame 40 (e.g., the left-side member 42, right-side member 44, etc.), and a bearing support 386 moveably coupled to the frame 40. The bearing support 386 supports the idler shaft 434 and may be slidably coupled to the frame 40 using fasteners through axially or longitudinally extending slots in the from 40 (see, e.g., slots 388 in FIG. 38 which support the front shaft assembly 50). An end of the adjustment screw 382 pushes against the bearing support 386 such that advancement of the adjustment screw 382 causes increased tension in the chain 436, and refraction of the adjustment screw 382 causes reduction of the tension on the chain 436. According to one embodiment, the length of the gait of the walking rehabilitation device 316 may be changed by replacing the chain 436 with a longer or shorter chain, moving the bearing supports 386 fore or aft, respectively, and adjusting the adjustment system 380 to provide to the appropriate tension on the chain 436. Accordingly, the walking rehabilitation device 316 may be adjusted to accommodate taller or shorter rehabilitees.

Figure 35:
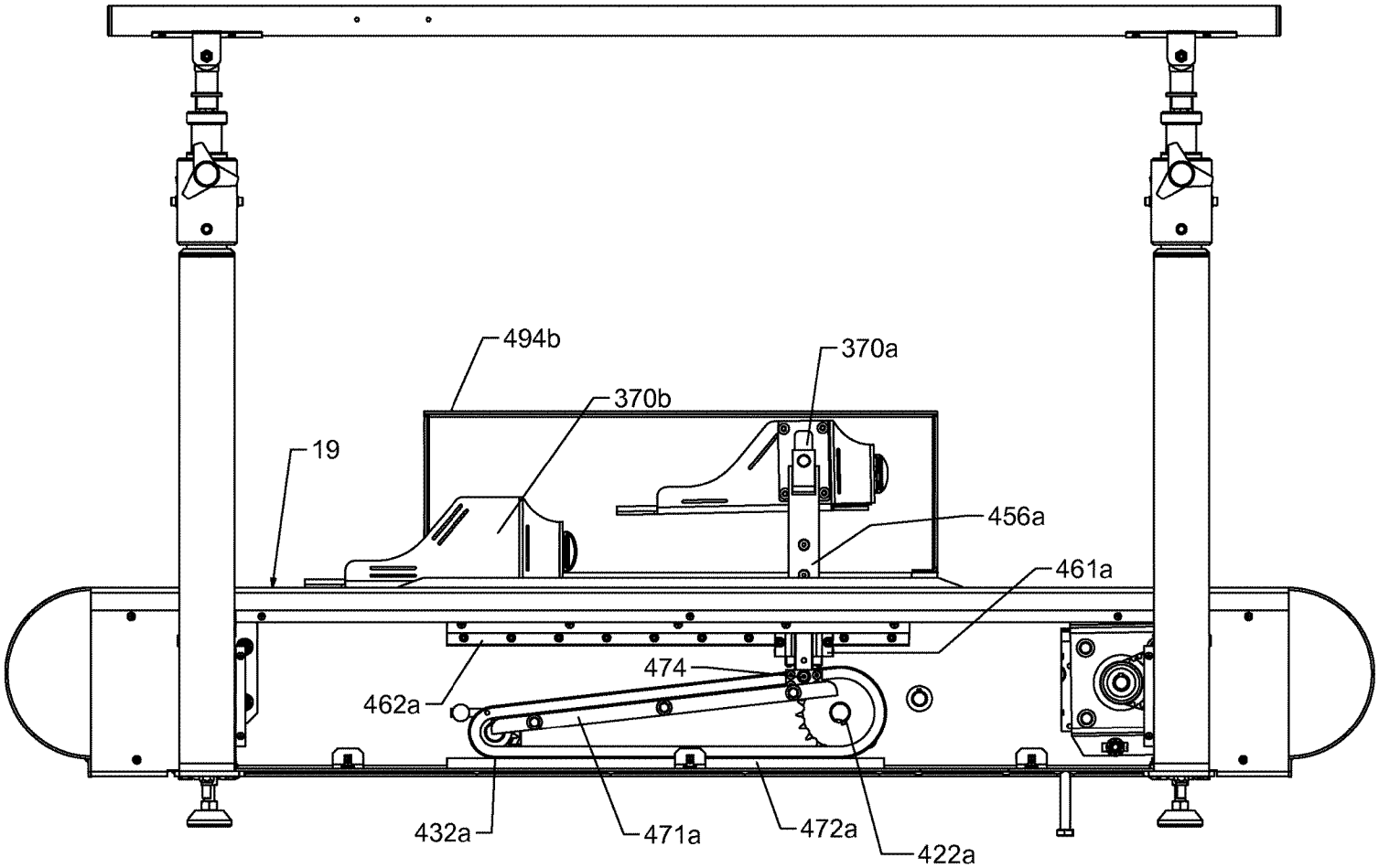
FIG. 35 is a left-side elevation view of a portion of the components of the treadmill of FIG. 30, shown according to an exemplary embodiment.

Referring to FIGS. 34-36, the treadmill 10 may include covers 494, shown as left-side cover **494*a* and right-side cover 494*b*. The cover 494 is configured to protect the transmission 400 from debris and inadvertent contact by a user or therapist. The cover 494 is shown to have a top 495 removably and/or movably (e.g., hingedly, etc.) coupled to a base 496. Removably and/or movably coupling the top 495 to the base 496 allows the top 495 to be quickly moved or rotated out of the way so that adjustments may be made to the follower assembly 450, or so that the follower assembly 450 may be removed from the vertical member 452. The base 496 includes a slot 497 configured to align with the openings 30, 32 in the side panels 28, 29 to allow for the follower assembly 450 of the walking rehabilitation device 316 to extend above the walking belt 18 and to be operatively coupled to the rehabilitee. It should be noted that brushes or other similar elements may be disposed in the slots 497 to help prevent undesired objects from entering the slots 497 and openings 30, 32. The base 496 may include one or more studs 498 (e.g., bosses, protrusions, pins, etc.) configured to align with and to be received by holes in a top surface of the side panels 28, 29 to prevent inadvertent or accidental movement of the cover 494**.

Figure 37:
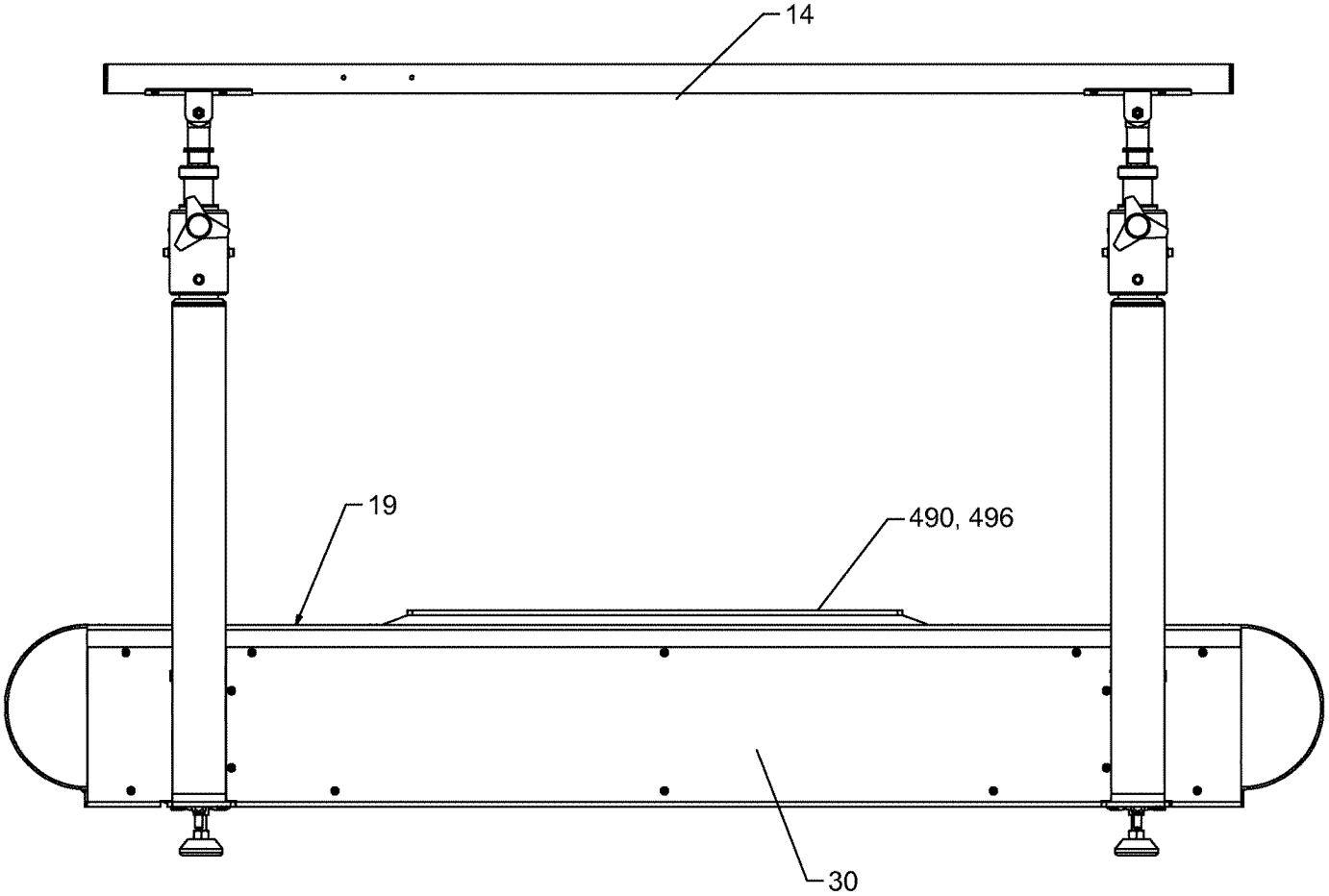
FIG. 37 is a side elevation view of a portion of the components of the treadmill of FIG. 30, shown according to another exemplary embodiment.

Referring to FIG. 37, the treadmill 10 may include covers 490. When a user desires to use the treadmill 10 without the walking rehabilitation device 316, the covers 494 may be removed, and a cover 490 may be installed in its place. According to one embodiment, the cover 490 has a generally similar shape to the base 496 but does not include a slot 497 for the vertical member 452 to extend through, thereby protecting the transmission 400 from debris and foreign objects. The cover 490 may include one or more studs 498 configured to align with and to be received by holes in the top surface of the side panels 28, 29 to prevent inadvertent or accidental movement of the cover 490. According to another embodiment, the top 495 may be removed from the base 496, and the cover 490 may be coupled to the base 496 to cover the slot 497.

Figure 23:
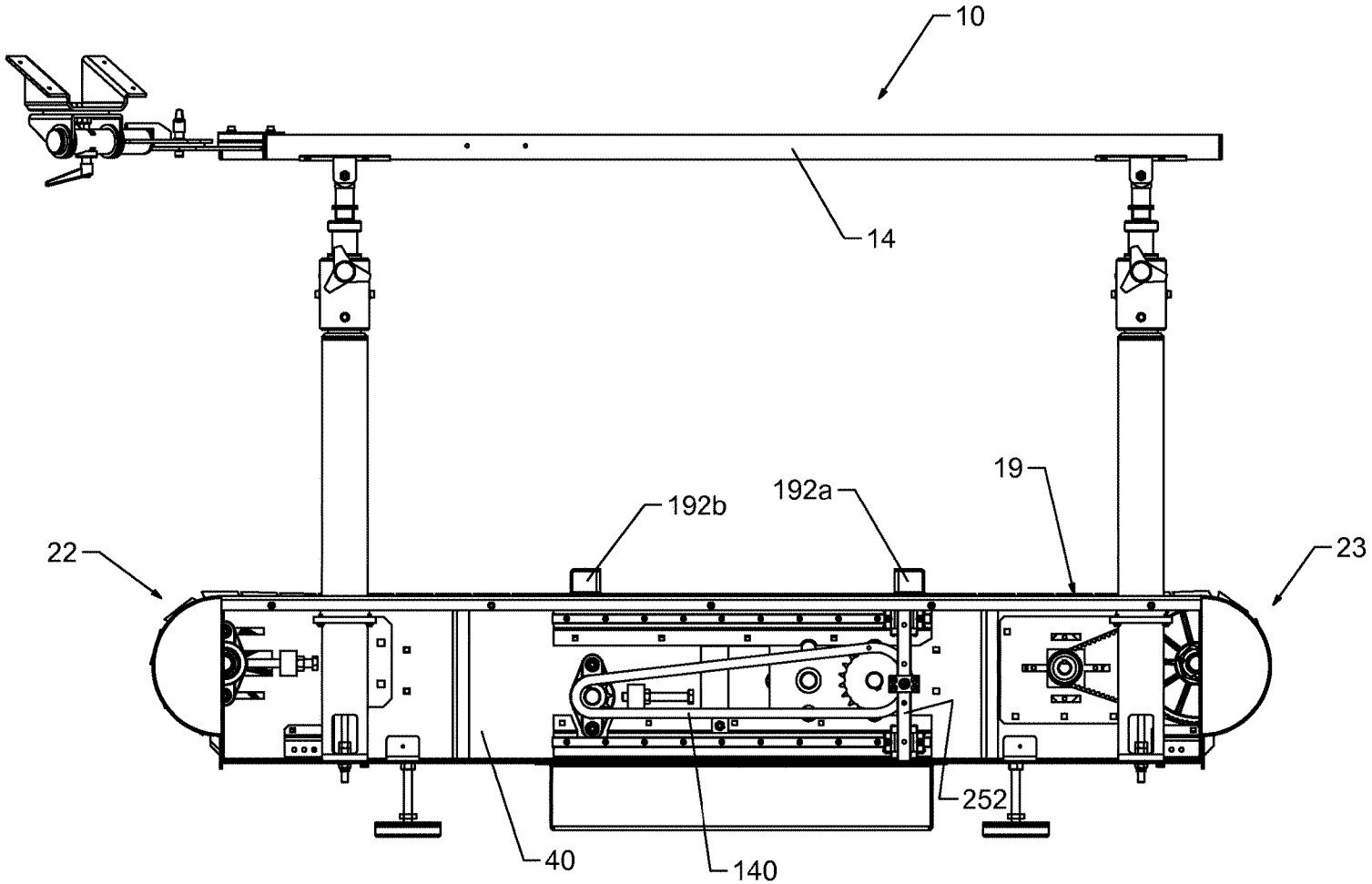
FIG. 23 is a left-side elevation view of a portion of the components of the treadmill of FIG. 18, shown according to another exemplary embodiment.
Figure 24:
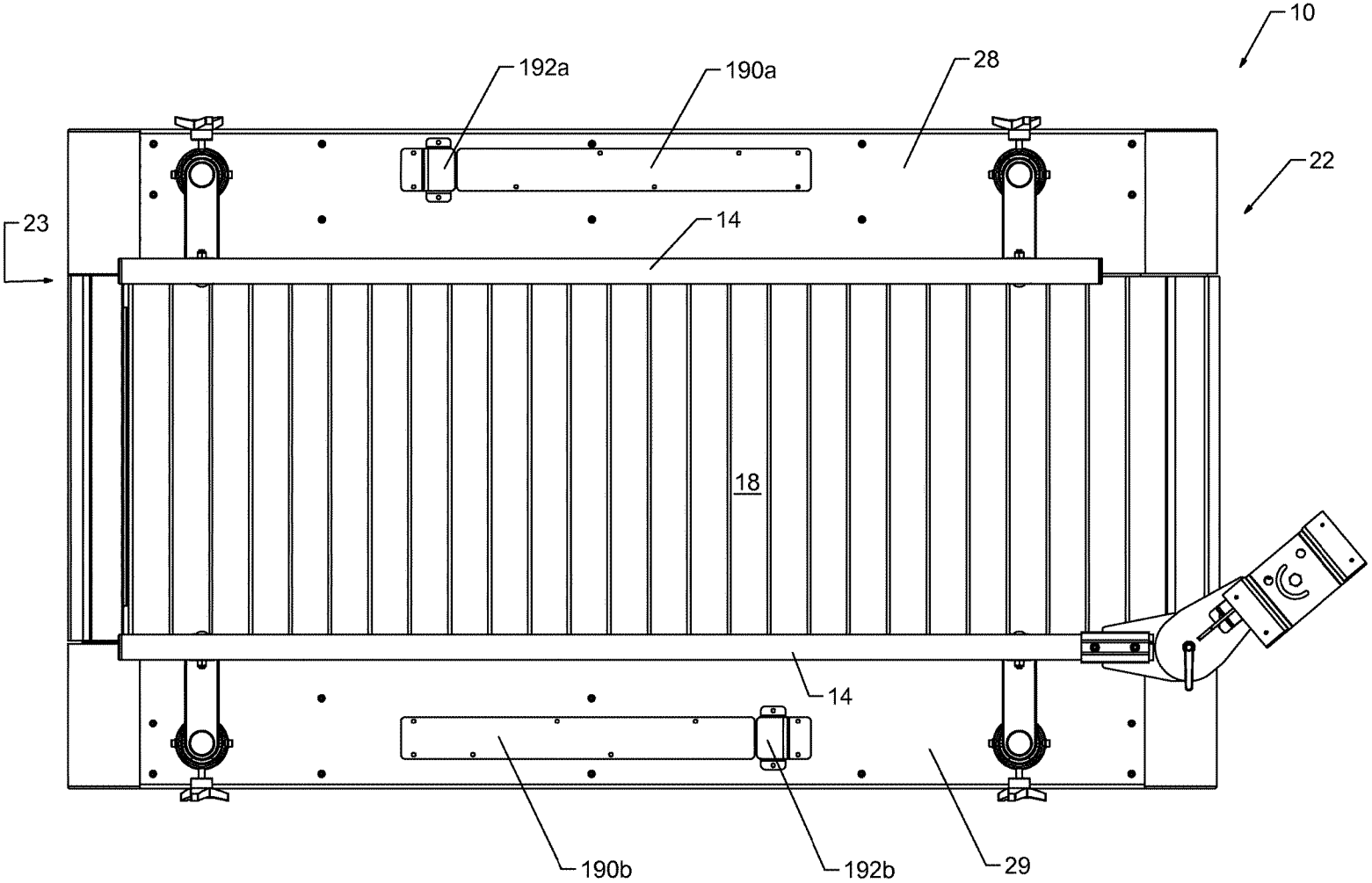
FIG. 24 is a top plan view of a portion of the components of the treadmill of FIG. 23, shown according to another exemplary embodiment.

Referring to FIGS. 23 and 24, one or more covers 190, shown as left cover 190*a* and right cover 190*b*, may be installed over the openings 30, 32 in the side panels 28, 29 and the frame 40 to prevent debris from entering the treadmill 10 or from inadvertent contact with the vertical member 152, 252. The cover 190 may include an opening that is covered by a hollow protrusion, shown as cap 192. The cap 192 may be coupled to the cover 190, and the cavity of the cap 192 is configured to receive the top of the vertical member 152, 252, protecting the vertical member 152, 252 from inadvertent contact. The cap 192 and the opening in the cover 190 limits the motion of the vertical member 152, 252, thereby preventing the other vertical member 152*a*, 152*b* from rising above the walking surface 19 unexpectedly. The left and right covers 192*a*, 192*b* may be installed the same longitudinal orientation, or may be installed in a reverse orientation, as shown. According to one embodiment, the cover 190 may be configured to complete a circuit, close a switch, etc., thereby preventing engagement of the clutch 180. For example, when the cover 190 is installed into the treadmill 10 (e.g., placed into or over the openings 30, 32, the cover 190 may open a switch, which, in turn, prevents actuation of the clutch 180. According to one embodiment, opening the switch prevents an electrical signal from reaching the clutch 180. According to another embodiment, opening (or closing) the switch pulls a cable, which inhibits mechanical engagement of the clutch 180. Preventing engagement of the clutch 180 when the covers 190 are installed prevent the vertical members 152, 252 from rising up and dislodging the covers 190.

The construction and arrangement of the elements of the treadmill as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A treadmill for providing walking rehabilitation to a rehabilitee, comprising:

a base including a belt;

a motor interconnected with the belt, the motor causing the belt to rotate in a first direction;

a walking rehabilitation device interconnected with the base, the walking rehabilitation device comprising:

a user engagement structure configured to be removably secured to one or more locations of a rehabilitee's extremities; and a transmission interconnecting the motor and the user engagement structure, the transmission configured to transfer motion from the motor to the rehabilitee via the user engagement structure, allowing the rehabilitee to walk along the belt.

2. The treadmill of claim 1, further comprising a follower assembly coupled to the user engagement structure and extending below the walking surface, wherein the follower assembly comprises a joint having a user engagement side and a transmission side, the joint configured to couple the user engagement structure to the transmission and to decouple the user engagement structure from the transmission when sufficient differential load is created between the user engagement side of the joint and the transmission side of the joint.

3. The treadmill of claim 2, wherein the follower assembly comprises:

a first member extending below the walking surface; and a second member coupled to the user engagement structure;

wherein the second member is rotatably coupled to the first member such that the second member is configured to be rotated away from the belt.

4. The treadmill of claim 1, wherein the transmission comprises a clutch, and wherein when the clutch is in a first state, motion is configured to be transferred from the motor to the user engagement structure, and when the clutch is in a second state, motion is configured to not be transferred from the motor to the user engagement structure via the transmission.

5. The treadmill of claim 1, wherein the transmission comprises:

a chain rotatably interconnected to the motor;

a member coupled to a chain; and a shuttle slidably coupled to a rail supported by the base;

wherein the member is slidably coupled to the shuttle.

6. The treadmill of claim 1, wherein:

the base supports a first shaft and a second shaft;

the belt extends around the first shaft and the second shaft;

the motor is interconnected with the first shaft, the motor is configured to cause the first shaft to rotate in a first direction, the first shaft is configured to cause the belt to rotate in the first direction; and the transmission is configured to transfer motion from at least one of the first shaft and the second shaft to the rehabilitee via the user engagement structure, allowing the rehabilitee to walk along the belt.

7. The treadmill of claim 6, wherein the transmission comprises:

a reverse shaft;

a power takeoff configured to transfer rotation from at least one of the first shaft and the second shaft to the reverse shaft; and a drive shaft configured to transfer kinetic energy to the user engagement structure;

wherein the drive shaft is rotationally coupled to the reverse shaft such that the drive shaft and the at least one of the first shaft and the second shaft rotate in the same direction.

8. An apparatus for providing walking rehabilitation to a rehabilitee on a treadmill having a walking belt, the walking belt powered by a motor and defining a walking surface, the apparatus comprising:

a user engagement structure configured to be removably secured to one or more locations of a rehabilitee's extremities; and a transmission coupled to the user engagement structure and configured to take power from the motor that is not transferred through the walking belt, the transmission configured to transform power from the motor into motion of the user engagement structure, thereby allowing the rehabilitee to walk along the walking belt.

9. The apparatus of claim 8, wherein the transmission comprises a clutch, and wherein when the clutch is in a first state, motion is configured to be transferred from the motor to the user engagement structure, and when the clutch is in a second state, motion is configured to not be transferred from the motor to the user engagement structure via the transmission.

10. The apparatus of claim 8, wherein the transmission comprises a joint having a user engagement side and a motor side, the joint configured to couple the user engagement structure to the motor and to decouple the user engagement structure from the motor when sufficient differential load is created between the user engagement side of the joint and the motor side of the joint.

11. The apparatus of claim 10, wherein the joint couples a first member coupled to the user engagement structure and a second member extending below the walking surface.

12. The apparatus of claim 10, wherein the joint comprises a housing coupled to the user engagement structure and a block interconnected to the motor, the block being releasably coupled to the housing.

13. The treadmill of claim 12, wherein the block is rotatably coupled to a member, and wherein the joint is configured to limit a rotational angle of the user engagement structure limited relative to the member.

14. The apparatus of claim 8, wherein the user engagement structure is rotatably coupled to the transmission about an axis of rotation, and wherein the user engagement structure comprises an adjustable heel portion configured to align the rehabilitee's ankle with the axis of rotation.

15. A method providing walking rehabilitation, comprising:

providing a treadmill including:

a base including a belt;

a motor interconnected with the belt;

a walking rehabilitation device interconnected with the base, the walking rehabilitation device comprising:

a user engagement structure configured to be removably secured to one or more locations of a rehabilitee's extremities; and a transmission interconnecting the motor and the user engagement structure separately from the belt;

causing the belt to rotate in a first direction via power from the motor; and transferring motion from the motor to the rehabilitee via the user engagement structure, thereby allowing the rehabilitee to walk along the belt.

16. The method of claim 15, wherein the transmission comprises a clutch; and further comprising disengaging the clutch such that motion is not transferred from the motor to the user engagement structure via the transmission while motion is transferred from the motor to the belt.

* * * * *